US009260927B2

(12) United States Patent
Hannegan et al.

(10) Patent No.: US 9,260,927 B2
(45) **Date of Patent: *Feb. 16, 2016**

(54) SYSTEM AND METHOD FOR MANAGING HEAVE PRESSURE FROM A FLOATING RIG

(71) Applicant: WEATHERFORD TECHNOLOGY HOLDINGS, LLC, Houston, TX (US)

(72) Inventors: Don M. Hannegan, Fort Smith, AR (US); Thomas F. Bailey, Abilene, TX (US); Simon J. Harrall, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/517,377

(22) Filed: Oct. 17, 2014

(65) Prior Publication Data

US 2015/0034326 A1 Feb. 5, 2015

Related U.S. Application Data

(63) Continuation of application No. 13/735,303, filed on Jan. 7, 2013, now Pat. No. 8,863,858, which is a continuation of application No. 12/761,714, filed on Apr. 16, 2010, now Pat. No. 8,347,982.

(51) Int. Cl.
*E21B 7/12* (2006.01)
*E21B 17/07* (2006.01)
(Continued)

(52) U.S. Cl.
CPC ..... *E21B 19/006* (2013.01); *B63B 35/4413* (2013.01); *E21B 7/12* (2013.01); *E21B 19/09* (2013.01); *E21B 21/08* (2013.01); *E21B 33/064* (2013.01); *E21B 33/085* (2013.01);
(Continued)

(58) Field of Classification Search
CPC ..... E21B 7/12; E21B 19/006; E21B 19/09; E21B 21/08; E21B 33/064; E21B 33/085; E21B 47/0001
USPC ..... 175/5, 207, 216, 218; 166/347, 355, 166/358, 367, 84.3; 405/224.2–224.4
See application file for complete search history.

(56) References Cited

U.S. PATENT DOCUMENTS 517,509 A 4/1894 Williams
1,157,644 A 10/1915 London
(Continued)

FOREIGN PATENT DOCUMENTS

AU 199927822 B2 9/1999
AU 200028183 A1 9/2000
(Continued)

OTHER PUBLICATIONS

U.S. Appl. No. 60/079,641, Abandoned, Mar. 27, 1998.
(Continued)

*Primary Examiner* — Matthew Buck
(74) *Attorney, Agent, or Firm* — Strasburger & Price, LLP

(57) ABSTRACT

A system compensates for heave induced pressure fluctuations on a floating rig when a drill string or tubular is lifted off bottom and suspended on the rig, such as when tubular connections are made during MPD, tripping, or when a kick is circulated out during conventional drilling. The system also compensates for heave induced pressure fluctuations on a floating rig when a riser telescoping joint located below a RCD is moving while drilling.

32 Claims, 6 Drawing Sheets

(51) Int. Cl.

| | |
|---|---|
| ***E21B 19/09*** | (2006.01) |
| ***E21B 21/08*** | (2006.01) |
| ***E21B 33/08*** | (2006.01) |
| ***E21B 19/00*** | (2006.01) |
| ***B63B 35/44*** | (2006.01) |
| ***E21B 33/064*** | (2006.01) |
| ***E21B 34/04*** | (2006.01) |
| ***E21B 47/00*** | (2012.01) |
| *E21B 21/00* | (2006.01) |

(52) U.S. Cl.
CPC ..... *E21B 34/04* (2013.01); *E21B 47/0001* (2013.01); *E21B 2021/006* (2013.01)

(56) References Cited

U.S. PATENT DOCUMENTS 1,472,952 A 11/1923 Anderson
1,503,476 A 8/1924 Childs et al.
1,528,560 A 3/1925 Myers et al.
1,546,467 A 7/1925 Bennett
1,560,763 A 11/1925 Collins
1,700,894 A 2/1929 Joyce et al.
1,708,316 A 4/1929 MacClatchie
1,769,921 A 7/1930 Hansen
1,776,797 A 9/1930 Sheldon
1,813,402 A 7/1931 Hewitt
2,038,140 A 7/1931 Stone
1,831,956 A 11/1931 Harrington
1,836,470 A 12/1931 Humason et al.
1,902,906 A 3/1933 Seamark
1,942,366 A 1/1934 Seamark
2,036,537 A 4/1936 Otis
2,071,197 A 2/1937 Burns et al.
2,124,015 A 7/1938 Stone et al.
2,126,007 A 8/1938 Gulberson et al.
2,144,682 A 1/1939 MacClatchie
2,148,844 A 2/1939 Stone et al.
2,163,813 A 6/1939 Stone et al.
2,165,410 A 7/1939 Penick et al.
2,170,915 A 8/1939 Schweitzer
2,170,916 A 8/1939 Schweitzer et al.
2,175,648 A 10/1939 Roach
2,176,355 A 10/1939 Otis
2,185,822 A 1/1940 Young
2,199,735 A 5/1940 Beckman
2,211,122 A 8/1940 Howard
2,222,082 A 11/1940 Leman et al.
2,233,041 A 2/1941 Alley
2,243,340 A 5/1941 Hild
2,243,439 A 5/1941 Pranger et al.
2,287,205 A 6/1942 Stone
2,303,090 A 11/1942 Pranger et al.
2,313,169 A 3/1943 Penick et al.
2,325,556 A 7/1943 Taylor, Jr. et al.
2,338,093 A 1/1944 Caldwell
2,480,955 A 9/1949 Penick
2,506,538 A 5/1950 Bennett
2,529,744 A 11/1950 Schweitzer, Jr.
2,609,836 A 9/1952 Knox
2,628,852 A 2/1953 Voytech
2,646,999 A 7/1953 Barske
2,649,318 A 8/1953 Skillman
2,731,281 A 1/1956 Knox
2,746,781 A 5/1956 Jones
2,760,750 A 8/1956 Schweitzer, Jr. et al.
2,760,795 A 8/1956 Vertson
2,764,999 A 10/1956 Stanbury
2,808,229 A 10/1957 Bauer et al.
2,808,230 A 10/1957 McNeil et al.
2,846,178 A 8/1958 Minor
2,846,247 A 8/1958 Davis
2,853,274 A 9/1958 Collins
2,862,735 A 12/1958 Knox
2,886,350 A 5/1959 Horne
2,904,357 A 9/1959 Knox
2,927,774 A 3/1960 Ormsby
2,929,610 A 3/1960 Stratton
2,962,096 A 11/1960 Knox
2,995,196 A 8/1961 Gibson et al.
3,023,012 A 2/1962 Wilde
3,029,083 A 4/1962 Wilde
3,032,125 A 5/1962 Hiser et al.
3,033,011 A 5/1962 Garrett
3,052,300 A 9/1962 Hampton
3,096,999 A 7/1963 Ahlstone et al.
3,100,015 A 8/1963 Regan
3,128,614 A 4/1964 Auer
3,134,613 A 5/1964 Regan
3,176,996 A 4/1965 Barnett
3,203,358 A 8/1965 Regan et al.
3,209,829 A 10/1965 Haeber
3,216,731 A 11/1965 Dollison
3,225,831 A 12/1965 Knox
3,259,198 A 7/1966 Montgomery et al.
3,268,233 A 8/1966 Brown
3,285,352 A 11/1966 Hunter
3,288,472 A 11/1966 Watkins
3,289,761 A 12/1966 Smith et al.
3,294,112 A 12/1966 Watkins
3,302,048 A 1/1967 Gray
3,313,345 A 4/1967 Fischer
3,313,358 A 4/1967 Postlewaite et al.
3,323,773 A 6/1967 Walker
3,333,870 A 8/1967 Watkins
3,347,567 A 10/1967 Watkins
3,360,048 A 12/1967 Watkins
3,372,761 A 3/1968 van Gils
3,387,851 A 6/1968 Cugini
3,397,928 A 8/1968 Galle
3,400,938 A 9/1968 Williams
3,401,600 A 9/1968 Wood
3,405,763 A 10/1968 Pitts et al.
3,421,580 A 1/1969 Fowler et al.
3,424,197 A 1/1969 Yanagisawa
3,443,643 A 5/1969 Jones
3,445,126 A 5/1969 Watkins
3,452,815 A 7/1969 Watkins
3,472,518 A 10/1969 Harlan
3,476,195 A 11/1969 Galle
3,481,610 A 12/1969 Slator et al.
3,485,051 A 12/1969 Watkins
3,492,007 A 1/1970 Jones
3,493,043 A 2/1970 Watkins
3,503,460 A 3/1970 Gadbois
3,522,709 A 8/1970 Vilain
3,529,835 A 9/1970 Lewis
3,561,723 A 2/1971 Cugini
3,583,480 A 6/1971 Regan
3,587,734 A 6/1971 Shaffer
3,603,409 A * 9/1971 Watkins ..... 175/7
3,621,912 A 11/1971 Wooddy, Jr.
3,631,834 A 1/1972 Gardner et al.
3,638,721 A 2/1972 Harrison
3,638,742 A 2/1972 Wallace
3,653,350 A 4/1972 Koons et al.
3,661,409 A 5/1972 Brown et al.
3,664,376 A 5/1972 Watkins
3,667,721 A 6/1972 Vujasinovic
3,677,353 A 7/1972 Baker
3,724,862 A 4/1973 Biffle
3,741,296 A 6/1973 Murman et al.
3,779,313 A 12/1973 Regan
3,815,673 A * 6/1974 Bruce et al. ..... 166/359
3,827,511 A 8/1974 Jones
3,847,215 A 11/1974 Herd
3,868,832 A 3/1975 Biffle
3,872,717 A 3/1975 Fox
3,910,110 A * 10/1975 Jefferies et al. ..... 73/152.21
3,924,678 A 12/1975 Ahlstone
3,934,887 A 1/1976 Biffle
3,952,526 A 4/1976 Watkins et al.
3,955,622 A 5/1976 Jones
3,965,987 A 6/1976 Biffle

(56) References Cited

U.S. PATENT DOCUMENTS 3,976,148 A * 8/1976 Maus et al. ..... 175/7
3,984,990 A 10/1976 Jones
3,992,889 A 11/1976 Watkins et al.
3,999,766 A 12/1976 Barton
4,037,890 A 7/1977 Kurita et al.
4,046,191 A 9/1977 Neath
4,052,703 A 10/1977 Collins, Sr. et al.
4,053,023 A 10/1977 Herd et al.
4,063,602 A 12/1977 Howell et al.
4,081,039 A * 3/1978 Wardlaw ..... 175/7
4,087,097 A 5/1978 Bossens et al.
4,091,881 A * 5/1978 Maus ..... 175/7
4,098,341 A 7/1978 Lewis
4,099,583 A * 7/1978 Maus ..... 175/7
4,109,712 A 8/1978 Regan
4,135,841 A * 1/1979 Watkins ..... 405/196
4,143,880 A 3/1979 Bunting et al.
4,143,881 A 3/1979 Bunting
4,149,603 A 4/1979 Arnold
4,154,448 A 5/1979 Biffle
4,157,186 A 6/1979 Murray et al.
4,183,562 A 1/1980 Watkins et al.
4,200,312 A 4/1980 Watkins
4,208,056 A 6/1980 Biffle
4,216,834 A * 8/1980 Wardlaw ..... 175/7
4,216,835 A 8/1980 Nelson
4,222,590 A 9/1980 Regan
4,249,600 A 2/1981 Bailey
4,281,724 A 8/1981 Garrett
4,282,939 A * 8/1981 Maus et al. ..... 175/7
4,285,406 A 8/1981 Garrett et al.
4,291,772 A * 9/1981 Beynet ..... 175/5
4,293,047 A 10/1981 Young
4,304,310 A 12/1981 Garrett
4,310,058 A 1/1982 Bourgoyne, Jr.
4,312,404 A 1/1982 Morrow
4,313,054 A 1/1982 Martini
4,326,584 A 4/1982 Watkins
4,335,791 A 6/1982 Evans
4,336,840 A 6/1982 Bailey
4,337,653 A 7/1982 Chauffe
4,345,769 A 8/1982 Johnston
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,384,724 A 5/1983 Derman
4,386,667 A 6/1983 Millsapps, Jr.
4,387,771 A 6/1983 Jones
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A 1/1984 Lawson
4,439,068 A 3/1984 Pokladnik
4,440,232 A 4/1984 LeMoine
4,440,239 A 4/1984 Evans
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,457,489 A 7/1984 Gilmore
4,478,287 A 10/1984 Hynes et al.
4,480,703 A 11/1984 Garrett
4,484,753 A 11/1984 Kalsi
4,486,025 A 12/1984 Johnston
4,488,703 A 12/1984 Jones
4,497,592 A 2/1985 Lawson
4,500,094 A 2/1985 Biffle
4,502,534 A 3/1985 Roche et al.
4,508,313 A 4/1985 Jones
4,509,405 A 4/1985 Bates
4,519,577 A 5/1985 Jones
4,524,832 A * 6/1985 Roche et al. ..... 166/347
4,526,243 A 7/1985 Young
4,527,632 A 7/1985 Chaudot
4,529,210 A 7/1985 Biffle
4,531,580 A 7/1985 Jones
4,531,591 A 7/1985 Johnston
4,531,593 A 7/1985 Elliott et al.
4,531,951 A 7/1985 Burt et al.
4,533,003 A 8/1985 Bailey
4,540,053 A 9/1985 Baugh et al.
4,546,828 A * 10/1985 Roche ..... 166/84.4
4,553,591 A 11/1985 Mitchell
D282,073 S 1/1986 Bearden et al.
4,566,494 A 1/1986 Roche
4,575,426 A 3/1986 Bailey et al.
4,595,343 A 6/1986 Thompson et al.
4,597,447 A * 7/1986 Roche et al. ..... 166/347
4,597,448 A 7/1986 Baugh
4,610,319 A 9/1986 Kalsi
4,611,661 A 9/1986 Hed et al.
4,615,542 A * 10/1986 Ideno et al. ..... 285/11
4,615,544 A 10/1986 Baugh
4,618,314 A 10/1986 Hailey
4,621,655 A 11/1986 Roche
4,623,020 A 11/1986 Nichols
4,626,135 A * 12/1986 Roche ..... 405/224.2
4,630,680 A 12/1986 Elkins
4,632,188 A 12/1986 Schuh et al.
4,646,826 A 3/1987 Bailey et al.
4,646,844 A 3/1987 Roche et al.
4,651,830 A 3/1987 Crotwell
4,660,863 A 4/1987 Bailey
4,688,633 A 8/1987 Barkley
4,690,220 A 9/1987 Braddick
4,697,484 A 10/1987 Klee et al.
4,709,900 A 12/1987 Dyhr
4,712,620 A * 12/1987 Lim et al. ..... 166/355
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,757,584 A 7/1988 Pav et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,822,212 A 4/1989 Hall et al.
4,825,938 A 5/1989 Davis
4,828,024 A 5/1989 Roche
4,832,126 A 5/1989 Roche
4,836,289 A 6/1989 Young
4,844,406 A 7/1989 Wilson
4,865,137 A 9/1989 Bailey
4,882,830 A 11/1989 Carstensen
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,035,292 A 7/1991 Bailey
5,040,600 A 8/1991 Bailey et al.

(56) References Cited

U.S. PATENT DOCUMENTS 5,048,621 A 9/1991 Bailey
5,062,450 A 11/1991 Bailey
5,062,479 A 11/1991 Bailey et al.
5,072,795 A 12/1991 Delgado et al.
5,076,364 A 12/1991 Hale et al.
5,082,020 A 1/1992 Bailey
5,085,277 A 2/1992 Hopper
5,101,897 A 4/1992 Leismer et al.
5,137,084 A 8/1992 Gonzales et al.
5,147,559 A 9/1992 Brophey et al.
5,154,231 A 10/1992 Bailey et al.
5,163,514 A 11/1992 Jennings
5,165,480 A 11/1992 Wagoner et al.
5,178,215 A 1/1993 Yenulis et al.
5,182,979 A 2/1993 Morgan
5,184,686 A 2/1993 Gonzalez
5,195,754 A 3/1993 Dietle
5,205,165 A 4/1993 Jardine et al.
5,213,158 A 5/1993 Bailey et al.
5,215,151 A 6/1993 Smith et al.
5,224,557 A 7/1993 Yenulis et al.
5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey
5,431,220 A 7/1995 Bailey
5,443,129 A 8/1995 Bailey et al.
5,495,872 A 3/1996 Gallagher et al.
5,529,093 A 6/1996 Gallagher et al.
5,588,491 A 12/1996 Tasson et al.
5,607,019 A 3/1997 Kent
5,647,444 A 7/1997 Williams
5,657,820 A 8/1997 Bailey
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.
5,738,358 A 4/1998 Kalsi et al.
5,755,372 A 5/1998 Cimbura
5,823,541 A 10/1998 Dietle et al.
5,829,531 A 11/1998 Hebert et al.
5,848,643 A 12/1998 Carbaugh et al.
5,848,656 A * 12/1998 Møksvold ..... 175/7
5,873,576 A 2/1999 Dietle et al.
5,878,818 A 3/1999 Hebert et al.
5,901,964 A 5/1999 Williams et al.
5,944,111 A 8/1999 Bridges
5,952,569 A 9/1999 Jervis
5,960,881 A 10/1999 Allamon et al.
6,007,105 A 12/1999 Dietle et al.
6,016,880 A 1/2000 Hall et al.
6,017,168 A 1/2000 Fraser, Jr.
6,036,192 A 3/2000 Dietle et al.
6,039,118 A 3/2000 Carter et al.
6,050,348 A 4/2000 Richarson et al.
6,070,670 A 6/2000 Carter et al.
6,076,606 A 6/2000 Bailey
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey
6,120,036 A 9/2000 Kalsi et al.
6,129,152 A 10/2000 Hosie et al.
6,138,774 A 10/2000 Bourgoyne, Jr. et al.
6,170,576 B1 1/2001 Bailey
6,173,781 B1 * 1/2001 Milne et al. ..... 166/355
6,202,745 B1 3/2001 Reimert et al.
6,209,663 B1 4/2001 Hosie
6,213,228 B1 4/2001 Saxman
6,227,547 B1 5/2001 Dietle et al.
6,230,824 B1 * 5/2001 Peterman et al. ..... 175/214
6,244,359 B1 6/2001 Bridges et al.
6,263,982 B1 7/2001 Hannegan et al.
6,273,193 B1 * 8/2001 Hermann et al. ..... 166/359
6,315,302 B1 11/2001 Conroy et al.
6,315,813 B1 11/2001 Morgan et al.
6,325,159 B1 * 12/2001 Peterman et al. ..... 175/7
6,334,619 B1 1/2002 Dietle et al.
6,352,129 B1 * 3/2002 Best ..... 175/25
6,354,385 B1 3/2002 Ford et al.
6,361,830 B1 3/2002 Schenk
6,375,895 B1 4/2002 Daemen
6,382,634 B1 5/2002 Dietle et al.
6,386,291 B1 5/2002 Short
6,413,297 B1 7/2002 Morgan et al.
6,450,262 B1 9/2002 Regan
6,454,007 B1 9/2002 Bailey
6,454,022 B1 * 9/2002 Sangesland et al. ..... 175/7
6,457,529 B2 10/2002 Calder et al.
6,470,975 B1 10/2002 Bourgoyne et al.
6,474,422 B2 * 11/2002 Schubert et al. ..... 175/69
6,478,303 B1 11/2002 Radcliffe
6,494,462 B2 12/2002 Dietle
6,504,982 B1 1/2003 Greer, IV
6,505,691 B2 1/2003 Judge et al.
6,520,253 B2 2/2003 Calder
6,536,520 B1 3/2003 Snider et al.
6,536,525 B1 3/2003 Haugen et al.
6,547,002 B1 4/2003 Bailey et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,708,762 B2 3/2004 Haugen et al.
6,720,764 B2 4/2004 Relton et al.
6,725,951 B2 4/2004 Looper
6,732,804 B2 5/2004 Hosie et al.
6,749,172 B2 6/2004 Kinder
6,767,016 B2 7/2004 Gobeli et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,904,981 B2 6/2005 van Riet
6,913,092 B2 7/2005 Bourgoyne
6,945,330 B2 9/2005 Wilson et al.
7,004,444 B2 2/2006 Kinder
7,007,913 B2 3/2006 Kinder
7,011,167 B2 3/2006 Ebner
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,077,212 B2 7/2006 Roesner et al.
7,080,685 B2 7/2006 Bailey et al.
7,086,481 B2 8/2006 Hosie et al.
7,152,680 B2 12/2006 Wilson et al.
7,159,669 B2 1/2007 Bourgoyne et al.
7,165,610 B2 1/2007 Hopper
7,174,956 B2 2/2007 Williams et al.
7,178,600 B2 2/2007 Luke et al.
7,185,705 B2 * 3/2007 Fontana ..... 166/356
7,191,840 B2 3/2007 Bailey
7,198,098 B2 4/2007 Williams
7,204,315 B2 4/2007 Pia

(56) References Cited

U.S. PATENT DOCUMENTS

| | | | | |
|---|---|---|---|---|
| 7,219,729 | B2 | 5/2007 | Bostick et al. | |
| 7,237,618 | B2 | 7/2007 | Williams | |
| 7,237,623 | B2 | 7/2007 | Hannegan | |
| 7,240,727 | B2 | 7/2007 | Williams | |
| 7,243,958 | B2 | 7/2007 | Williams | |
| 7,255,173 | B2 | 8/2007 | Hosie et al. | |
| 7,258,171 | B2 | 8/2007 | Bailey et al. | |
| 7,264,058 | B2 * | 9/2007 | Fossli | 166/367 |
| 7,274,989 | B2 * | 9/2007 | Hopper | 702/6 |
| 7,278,494 | B2 | 10/2007 | Williams | |
| 7,278,496 | B2 | 10/2007 | Leuchtenberg | |
| 7,296,628 | B2 | 11/2007 | Robichaux | |
| 7,308,954 | B2 | 12/2007 | Martin-Marshall | |
| 7,325,610 | B2 | 2/2008 | Giroux et al. | |
| 7,334,633 | B2 | 2/2008 | Williams et al. | |
| 7,334,967 | B2 * | 2/2008 | Blakseth et al. | 405/224.2 |
| 7,347,261 | B2 | 3/2008 | Markel et al. | |
| 7,350,590 | B2 | 4/2008 | Hosie et al. | |
| 7,363,860 | B2 | 4/2008 | Wilson et al. | |
| 7,367,411 | B2 | 5/2008 | Leuchtenberg | |
| 7,377,334 | B2 | 5/2008 | May | |
| 7,380,590 | B2 | 6/2008 | Hughes | |
| 7,380,591 | B2 | 6/2008 | Williams | |
| 7,380,610 | B2 | 6/2008 | Williams | |
| 7,383,876 | B2 | 6/2008 | Gray et al. | |
| 7,389,183 | B2 | 6/2008 | Gray | |
| 7,392,860 | B2 | 7/2008 | Johnston | |
| 7,413,018 | B2 | 8/2008 | Hosie et al. | |
| 7,416,021 | B2 | 8/2008 | Williams | |
| 7,416,226 | B2 | 8/2008 | Williams | |
| 7,448,454 | B2 | 11/2008 | Bourgoyne et al. | |
| 7,451,809 | B2 | 11/2008 | Noske et al. | |
| 7,475,732 | B2 | 1/2009 | Hosie et al. | |
| 7,487,837 | B2 | 2/2009 | Bailey et al. | |
| 7,497,266 | B2 * | 3/2009 | Fossli | 166/358 |
| 7,513,300 | B2 | 4/2009 | Pietras et al. | |
| 7,559,359 | B2 | 7/2009 | Williams | |
| 7,635,034 | B2 | 12/2009 | Williams | |
| 7,650,950 | B2 | 1/2010 | Leuchtenberg | |
| 7,654,325 | B2 | 2/2010 | Giroux et al. | |
| 7,669,649 | B2 | 3/2010 | Williams | |
| 7,686,544 | B2 * | 3/2010 | Blakseth et al. | 405/224.2 |
| 7,699,109 | B2 | 4/2010 | May et al. | |
| 7,708,089 | B2 | 5/2010 | Williams | |
| 7,712,523 | B2 | 5/2010 | Snider et al. | |
| 7,717,169 | B2 | 5/2010 | Williams | |
| 7,717,170 | B2 | 5/2010 | Williams | |
| 7,726,416 | B2 | 6/2010 | Williams | |
| 7,743,823 | B2 | 6/2010 | Hughes et al. | |
| 7,762,320 | B2 | 7/2010 | Williams | |
| 7,766,100 | B2 | 8/2010 | Williams | |
| 7,779,903 | B2 | 8/2010 | Bailey et al. | |
| 7,789,132 | B2 | 9/2010 | Williams | |
| 7,789,172 | B2 | 9/2010 | Williams | |
| 7,793,719 | B2 | 9/2010 | Snider et al. | |
| 7,798,250 | B2 | 9/2010 | Williams | |
| 7,802,635 | B2 | 9/2010 | Leduc et al. | |
| 7,823,665 | B2 | 11/2010 | Sullivan | |
| 7,836,946 | B2 | 11/2010 | Bailey et al. | |
| 7,836,973 | B2 | 11/2010 | Belcher et al. | |
| 7,866,399 | B2 * | 1/2011 | Kozicz et al. | 166/367 |
| 7,926,593 | B2 * | 4/2011 | Bailey et al. | 175/87 |
| 8,033,335 | B2 * | 10/2011 | Orbell et al. | 166/367 |
| 8,347,982 | B2 * | 1/2013 | Hannegan et al. | 175/5 |
| 8,528,660 | B2 | 9/2013 | Santos | |
| 8,863,858 | B2 * | 10/2014 | Hannegan et al. | 175/5 |
| 2003/0106712 | A1 | 6/2003 | Bourgoyne et al. | |
| 2003/0164276 | A1 | 9/2003 | Snider et al. | |
| 2004/0017190 | A1 | 1/2004 | McDearmon et al. | |
| 2005/0151107 | A1 | 7/2005 | Shu | |
| 2005/0161228 | A1 | 7/2005 | Cook et al. | |
| 2006/0037782 | A1 | 2/2006 | Martin-Marshall | |
| 2006/0108119 | A1 | 5/2006 | Bailey et al. | |
| 2006/0144622 | A1 | 7/2006 | Bailey et al. | |
| 2006/0157282 | A1 | 7/2006 | Tilton et al. | |
| 2006/0191716 | A1 | 8/2006 | Humphreys | |
| 2007/0051512 | A1 | 3/2007 | Markel et al. | |
| 2007/0095540 | A1 | 5/2007 | Kozicz | |
| 2007/0163784 | A1 | 7/2007 | Bailey | |
| 2008/0105434 | A1 | 5/2008 | Orbell et al. | |
| 2008/0169107 | A1 | 7/2008 | Redlinger et al. | |
| 2008/0210471 | A1 * | 9/2008 | Bailey et al. | 175/48 |
| 2008/0236819 | A1 | 10/2008 | Foster et al. | |
| 2008/0245531 | A1 | 10/2008 | Noske et al. | |
| 2009/0025930 | A1 | 1/2009 | Iblings et al. | |
| 2009/0101351 | A1 | 4/2009 | Hannegan et al. | |
| 2009/0101411 | A1 | 4/2009 | Hannegan et al. | |
| 2009/0139724 | A1 | 6/2009 | Gray et al. | |
| 2009/0152006 | A1 | 6/2009 | Leduc et al. | |
| 2009/0166046 | A1 | 7/2009 | Edvardson et al. | |
| 2009/0200747 | A1 | 8/2009 | Williams | |
| 2009/0211239 | A1 | 8/2009 | Askeland | |
| 2009/0236144 | A1 | 9/2009 | Todd et al. | |
| 2009/0301723 | A1 | 12/2009 | Gray | |
| 2010/0008190 | A1 | 1/2010 | Gray et al. | |
| 2010/0025047 | A1 | 2/2010 | Sokol | |
| 2010/0175882 | A1 | 7/2010 | Bailey et al. | |
| 2011/0024195 | A1 | 2/2011 | Hoyer | |
| 2011/0036629 | A1 | 2/2011 | Bailey et al. | |
| 2011/0036638 | A1 | 2/2011 | Sokol | |
| 2011/0100710 | A1 * | 5/2011 | Fossli | 175/7 |
| 2012/0037361 | A1 | 2/2012 | Santos et al. | |
| 2012/0241163 | A1 * | 9/2012 | Reitsma et al. | 166/355 |
| 2013/0118752 | A1 | 5/2013 | Hannegan et al. | |
| 2014/0144703 | A1 | 5/2014 | Fossli | |

FOREIGN PATENT DOCUMENTS

| | | | |
|---|---|---|---|
| AU | 200028183 | B2 | 9/2000 |
| CA | 2363132 | A1 | 9/2000 |
| CA | 2447196 | A1 | 4/2004 |
| EP | 0290250 | A2 | 11/1988 |
| EP | 0290250 | A3 | 11/1988 |
| EP | 267140 | B1 | 3/1993 |
| EP | 1375817 | A1 | 1/2004 |
| EP | 1519003 | A1 | 3/2005 |
| EP | 1659260 | A2 | 5/2006 |
| GB | 1161299 | | 8/1969 |
| GB | 2019921 | A | 11/1979 |
| GB | 2067235 | A | 7/1981 |
| GB | 2394738 | A | 5/2004 |
| GB | 2394741 | A | 5/2004 |
| GB | 2449010 | A | 8/2007 |
| GB | 2478119 | A * | 8/2011 |
| WO | WO 93/06335 | | 4/1993 |
| WO | WO 99/45228 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO 00/52299 | A1 | 9/2000 |
| WO | WO 00/52300 | A1 | 9/2000 |
| WO | WO 01/79654 | A1 | 10/2001 |
| WO | WO 02/36928 | A1 | 5/2002 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |
| WO | WO 2009/123476 | A1 | 10/2009 |
| WO | WO 2011104279 | A2 * | 9/2011 |
| WO | WO 2012/021693 | A1 | 2/2012 |

OTHER PUBLICATIONS

U.S. Appl. No. 60/122,530, Abandoned, Mar. 2, 1999.

U.S. Appl. No. 61/205,209, Abandoned, Jan. 15, 2009.

The Modular T BOP Stack System, Cameron Iron Works ® 1985 (5 pages).

Cameron HC Collet Connector, ® Cooper Cameron Corporation, Cameron Division (12 pages).

(56) References Cited

OTHER PUBLICATIONS

Riserless drilling: circumventing the size/cost cycle in deepwater—Conoco, Hydril project seek enabling technologies to drill in deepest water depths economically, May 1986 Offshore Drilling Technology ( pp. 49, 50, 53, 54 and 55).
William Tool Company—Home Page—Under Construction Williams Rotating Control Heads (2 pages); Seal-Ability for the pressures of drilling (2 pages); William Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where Using a Williams rotating control head while drilling is a plus (1 page); Williams Higher pressure rotating control head systems are Ideally Suited for New Technology Flow Drilling and Closed Loop Underbalanced Drilling (UBD) Vertical and Horizontal (2 pages); and How to Contact Us (2 pages).
Offshore—World Trends and Technology for Offshore Oil and Gas Operations, Mar. 1998, Seismic: Article entitled, "Shallow Flow Diverter JIP Spurred by Deepwater Washouts"(3 pages) including cover page, table of contents and p. 90).
William Tool Co. Inc. Rotating Control Heads and Strippers for Air, Gas, Mud and Geothermal Drilling Worldwide—Sales Rental Service, © 1988 (19 pages).
Williams Tool Co., Inc. 19 page brochure © 1991 Williams Tool Co., Inc. (19 pages).
Fig. 19 Floating Piston Drilling Choke Design: May 1997.
Blowout Preventer Testing for Underbalanced Drilling by Charles R. "Rick" Stone and Larry A. Cress, Signa Engineering Corp., Houston, Texas (24 pages) Sep. 1997.
Williams Tool Co. Inc. Instructions, Assemble & Disassemble Model 9000 Bearing Assembly (cover page and 27 numbered pages).
Williams Tool Co., Inc. Rotating Control Heads Making Drilling Safer While Reducing Costs Since 1968, © 1989 (4 pages).
Williams Tool Company, Inc. International Model 7000 Rotating Control Head, 1991 (4 pages).
Williams Rotating Control Heads, Reduce Costs Increase Safety Reduce Environmental Impact, 4 pages, (© 1995).
Williams Tool Co., Inc. Sales-Rental-Service, Williams Rotating Control Heads and Strippers for Air, Gas, Mud, and Geothermal Drilling, © 1982 (7 pages).
Williams Tool Co., Inc., Rotating Control Heads and Strippers for Air, Gas, Mud, Geothermal and Pressure Drilling, © 1991 (19 pages).
An article—The Brief Jan. '96, The Brief's Guest Columnists, Williams Tool Co., Inc., Communicating Dec. 13, 1995 (Fort Smith, Arkansas), The When? and Why? of Rotating Control Head Usage, Copyright © Murphy Publishing, Inc. 1996 (2 pages).
A reprint from the Oct. 9, 1995 edition of Oil & Gas Journal, "Rotating control head applications increasing," by Adam T. Bourgoyne, Jr., Copyright 1995 by PennWell Publishing Company (6 pages).
1966-1967 Composite Catalog-Grant Rotating Drilling Head for Air, Gas or Mud Drilling (1 page).
1976-1977 Composite Catalog Grant Oil Tool Company Rotating Drilling Head Models 7068, 7368, 8068 (Patented), Equally Effective with Air, Gas, or Mud Circulation Media (3 pages).
A Subsea Rotating Control Head for Riserless Drilling Applications; Daryl A. Bourgoyne, Adam T. Bourgoyne, and Don Hannegan—1998 (International Association of Drilling Contractors International Deep Water Well Control Conference held in Houston, Texas, Aug. 26-27, 1998) (14 pages).
Hannegan, "Applications Widening for Rotating Control Heads," Drilling Contractor, cover page, table of contents and pp. 17 and 19, Drilling Contractor Publications Inc., Houston, Texas, Jul. 1996.
Composite Catalog, Hughes Offshore 1986-87 Subsea Systems and Equipment, Hughes Drilling Equipment Composite Catalog (pp. 2986-3004).
Williams Tool Co., Inc. Technical Specifications Model for the Model 7100, (3 pages).
Williams Tool Co., Inc. Website, Underbalanced Drilling (UBD), The Attraction of UBD (2pages).
Williams Tool Co., Inc. Website, "Applications, Where Using a Williams Rotating Control Head While Drilling is a Plus" (2 pages).
Williams Tool Co., Inc. Website, "Model 7100," (3 pages).
Composite Catalog, Hughes Offshore 1982/1983, Regan Products, © Copyright 1982 (Two cover sheets and 4308-27 thru 4308-43, and end sheet). See p. 4308-4336 Type KFD Diverter.
Coflexip Brochure; 1-Coflexip Sales Offices, 2-the Flexible Steel Pipe for Drilling and Service Applications, 3-New 5' I.D. General Drilling Flexible, 4-Applications, and 5-Illustration (5 unnumbered pages).
Baker, Ron, "A Primer of Oilwell Drilling," Fourth Edition, Published Petroleum Extension Service, The University of Texas at Austin, Austin, Texas, in cooperation with International Association of Drilling Contractors Houston, Texas © 1979 (3 cover pages and pp. 42-49 re Circulation System).
Brochure, Lock down Lubricator System, Dutch Enterprises, Inc., "Safety with Savings" (cover sheet and 16 unnumbered pages); see above U.S. Pat. No. 4,836,289 referred to therein.
Hydril GL series Annual Blowout Preventers (Patented—see Roche patents above), (cover sheet and 2 pages).
Other Hydril Product Information (The GH Gas Handler Series Product is Listed), © 1996, Hydril Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pp. 1562-1568).
Avoiding Explosive Unloading of Gas in a Deep Water Riser When SOBM in Use; Colin P. Leach & Joseph R. Roche—1998 (The Paper Describes an Application for the Hydril Gas Handler, The Hydril GH 211-2000 Gas Handler is Depicted in Figure 1 of the Paper) (9 unnumbered pages).
Feasibility Study of Dual Density Mud System for Deepwater Drilling Operations; Clovis A. Lopes & A.T. Bourgoyne, Jr.—1997 (Offshore Technology Conference Paper No. 8465); (pp. 257-266).
Apr. 1998 Offshore Drilling with Light Weight Fluids Joint Industry Project Presentation (9 unnumbered pages).
Nakagawa, Edson Y., Santos, Helio and Cunha, J.C., "Application of Aerated-Fluid Drilling in Deepwater," SPE/IACDC 52787 Presented by Don Hannegan, P.E., SPE © 1999 SPE/IADC Drilling Conference, Amsterdam, Holland, Mar. 9-11, 1999 (5 unnumbered pages).
Brochure: "Inter-Tech Drilling Solutions, Ltd.'s RBO™ Means Safety and Experience for Underbalanced Drilling," Inter-Tech Drilling Solutions Ltd./Big D Rentals & Sales (1981) Ltd. and Color Copy of "Rotating BOP" (2 unnumbered pages).
"Pressure Control While Drilling," Shaffer® A Varco Company, Rev. A (2 unnumbered pages).
Field Exposure (As of Aug. 1998), Shaffer® A Varco Company Rev. A (1 unnumbered page).
Graphic: "Rotating Spherical BOP" (1 unnumbered page).
"JIP's Worl Brightens Outlook for UBD in Deep Waters" by Edson Yoshihito Nakagawa, Helio Santos and Jose Carlos Cunha, American Oil & Gas Reporter, Apr. 1999, pp. 53, 56, 58-60 and 63.
"Seal-Tech 1500 PSI Rotating Blowout Preventer," Undated, 3 pages.
"RPM System 3000™ Rotating Blowout Preventer, Setting a new standard in Well Control," by Techcorp Industries, Undated, 4 pages.
"RiserCap™ Materials Presented at the 1999 LSU/MMS/IADC Well Control Workshop", by Williams Tool Company, Inc., Mar. 24-25, pp. 1-14.
"The 1999 LSU/MMS Well Control Workshop: An overview," by John Rogers Smith. World Oil, Jun. 1999. Cover page and pp. 4, 41-42, and 44-45.
Dag Oluf Nessa, "Offshore underbalanced drilling system could revive field developments," World Oil, vol. 218, No. 10, Oct. 1997, 1 unnumbered page and pp. 83-84, 86, and 88.
D.O. Nessa, "Offshore underbalanced drilling system could revive field developments," World Oil Exploration Drilling Production, vol. 218, No. 7, Color page of Cover pages and pp. 3, 61-64, and 66, Jul. 1997.
PCT Search Report, International Application No. PCT/US99/06695, 4 pages (Date of Completion May 27, 1999).
PCT Search Report, International Application No. PCT/GB00/00731, 3 pages (Date of Completion Jun. 16, 2000).

(56) References Cited

OTHER PUBLICATIONS

National Academy of Sciences—National Research Council, "Design of a Deep Ocean Drilling Ship," Cover Page and pp. 114-121. Undated but cited in the above U.S. Pat. No. 6230,824B1.
"History and Development of a Rotating Preventer," by A. Cress, Rick Stone, and Mike Tangedahl, IADC/SPE 23931, 1992 IADC/SPE Drilling Conference, Feb. 1992, pp. 757-773.
Helio Santos, Email message to Don Hannegan, et al., 1 page (Aug. 20, 2001).
Rehm, Bill, "Practical Underbalanced Drilling and Workover," Petroleum Extension Service, The University of Texas at Austin Continuing & Extended Education, Cover page, title page, copyright page, and pp. 6-6, 11-2, 11-3, G-9, and G-10 (2002).
Williams Tool Company Inc., "RiserCap™: Rotating Control Head System for Floating Drilling Rig Applications," 4 unnumbered pages, (© 1999 Williams Tool Company, Inc.).
Antonio C.V.M. Lage, Helio, Santos and Paulo R.C. Silva, Drilling with Aerated Drilling Fluid from a Floating Unit Part 2: Drilling the Well, SPE 71361, 11 pages (© 2001, Society of Petroleum Engineers, Inc.).
Helio Santos, Fabio Rosa, and Christian Leuchtenberg, Drilling and Aerated Fluid from a Floating Unit, Part 1: Planning, Equipment, Tests, and Rig Modifications, SPE/IADC 67748, 8 pages (© 2001 SPE/IADC Drilling Conference).
E.Y. Nakagawa, H. Santos, J.C. Cunha and S. Shayegi, Planning of Deepwater Drilling Operations with Aerated Fluids, SPE 54283, 7 pages, (© 1999, Society of Petroleum Engineers).
E.Y. Nakagawa, H.M.R. Santos and J.C. Cunha, Implementing the Light-Weight Fluids Drilling Technology in Deepwater Scenarios, 1999 LSU/MMS Well Control Workshop Mar. 24-25, 1999, 12 pages (1999).
Press Release, "Stewart & Stevenson Introduces First Dual Gradient Riser," Stewart & Stevenson, http:/www.ssss/com/ssss/20000831.asp, 2 pages (Aug. 31, 2000).
Press Release: "Stewart & Stevenson introduces First Dual Gradient Riser," Stewart & Stevenson, http:www/ssss/com/ssss/20000831.asp, 2 pages (Aug. 31, 2000).
Williams Tool Company Inc., "Williams Tool Company Introduces the . . . Virtual Riser™," 4 unnumbered pages, (©1998 Williams Tool Company, Inc.).
"PETEX Publications," Petroleum Extension Service, University of Texas at Austin, 12 pages, (last modified Dec. 6, 2002).
"BG in the Caspian region," SPE Review, Issue 164, 3 unnumbered pages. (May 2003).
"Field Cases as of Mar. 3, 2003," Impact Fluid Solutions, 6 pages (Mar. 3, 2003).
"Determine in the Safe Application of Underbalanced Drilling Technologies in Marine Environments—Technical Proposal," Maurer Technology, Inc., Cover page and pp. 2-13 (Jun. 17, 2002).
Colbert, John W., "John W. Colbert, P.E. Vice President Engineering Biographical Data," Signa Engineering Corp., 2 unnumbered pages (undated).
"Technical Training Courses," Parker Drilling Co., http:/www.parkerdrilling.com/news/tech.html, 5 pages (last visited, Sep. 5, 2003).
"Drilling equipment: Improvements from data recording to slim hole," Drilling Contractor, pp. 30-32, (Mar./Apr. 2000).
"Drilling conference promises to be informative," Drilling Contractor, p. 10 (Jan./Feb. 2002).
"Underbalanced and Air Drilling," OGCI, Inc., http:/www.ogci.com/course_info.asp?counselD=410, 2 pages, (2003).
"2003 SPE Calendar," Society of Petroleum Engineers, Google cache of http:/www.spe.org/spe/cda/views/events/eventMaster/0,1470,1648_2194_632303.00.html; for "mud cap drilling", 2 pages (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages (May 2002).
"Weatherford UnderBalanced Services: General Underbalance Presentation to the DTI," 71 unnumbered pages, © 2002.
Rach, Nina M., "Underbalanced near-balanced drilling are possible offshore," Oil & Gas Journal, Color Copies, pp. 39-44, (Dec. 1, 2003).
Forrest, Neil, et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages); particularly see p. 3, col. 1, ¶ 4 and col. 2, ¶ 5 and Figs. 4-6; cited in 7V below where indicated as "technical background".
Hannegan, D.M.; Bourgoyne, Jr., A.T.: "Deepwater Drilling with Lightweight Fluids—Essential Equipment Required," SPE/IADC 67708, pp. 1-6 (©2001, SPE/IADC Drilling Conference).
Hannegan, Don M., "Underbalanced Operations Continue Offshore Movement," SPE 68491, pp. 1-3, (©2001, Society of Petroleum Engineers, Inc.)
Hannegan, D. and Divine, R., "Underbalanced Drilling —Perceptions and Realities of Today's Technology in Offshore Applications," IADC/SPE 74448, p. 1-9, (© 2002, IADC/SPE Drilling Conference).
Hannegan, Don M. and Wanzer, Glen: "Well Control Considerations—Offshore Applications of Underbalanced Drilling Technology," SPE/IADC 79854, pp. 1-14, (© 2003, SPE/IADC Drilling Conference).
Bybee, Karen, "Offshore Applications of Underbalanced—Drilling Technology," Journal of Petroleum Technology, Cover Page and pp. 51-52, (Jan. 2004).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998) (see document T).
Lage, Antonio C.V.M.; Santos, Helio; Silva, Paulo R.C.; "Drilling with Aerated Drilling Fluid from a Floating Unit Part 2: Drilling the Well," Society of Petroleum Engineers, SPE 71361, pp. 1-11 (Sep. 30-Oct. 3, 2001)(see document BBB).
Furlow, William; "Shell's seafloor pump, solids removal key to ultra-deep, dual-gradient drilling (Skid ready for commercialization)," Offshore World Trends and Technology for Offshore Oil and Gas Operations, Cover page, table of contents, pp. 54, 2 unnumbered pages and 106 (Jun. 2001).
Rowden, Michael V.: "Advances in riserless drilling pushing the deepwater surface string envelope (Alternative to seawater, CaCl2 sweeps); "Offshore World Trends and Technology for Offshore Oil and Gas Operations, Cover page, table of contents, pp. 56, 58, and 106 (Jun. 2001).
Boye, John: "Multi Purpose Intervention Vessel Presentation," M.O.S.T. Multi Operational Service Tankers, Weatherford International, Jan. 2004, 43 pages. (© 2003).
GB Search Report, International Application No. GB 0324939.8, 1 page (Jan. 21, 2004).
MicroPatent® list of patents citing U.S. Pat. No. 3,476,195, printed on Jan. 24, 2003.
PCT Search Report, International Application No. PCT/EP2004/052167, 4 pages (Date of Completion Nov. 25, 2004).
PCT Written Opinion of the International Searching Authority, International Application No. PCT/EP2004/052167, 6 pages.
Supplementary European Search Report No. EP 99908371, 3 pages (Date of Completion Oct. 22, 2004).
*General Catalog*, 1970-1971, Vetco Offshore, Inc., Subsea Systems; cover page, company page and numbered pp. 4800, 4816-4818; 6 pages total, in particular see numbered p. 4816 for "patented" Vetco H-4 connectors.
*General Catalog*, 1972-73, Vetco Offshore, Inc., Subsea Systems; cover page; company page and numbered pp. 4498, 4509-4510; 5 pages total.
*General Catalog*, 1974-75, Vetco Offshore, Inc.; cover page, company page and numbered pp. 5160, 5178-5179; 5 pages total.
*General Catalog*, 1976-1977, Vetco Offshore, Inc., Subsea Drilling and Completion Systems; cover page and numbered pp. 5862-5863; 4 pages total.
*General Catalog*, 1982-1983, Vetco; cover page and numbered pp. 8454-8455, 8479; 4 pages total.

(56) References Cited

OTHER PUBLICATIONS

*Shaffer, A Varco Company: Pressure Control While Drilling System*, http:/www.tulsaequipm.com; printed Jun. 21, 2004; 2 pages.
*Performance Drilling by Precision Drilling. A Smart Equation*, Precision Drilling, © 2002 Precision Drilling Corporation; 12 pages, in particular see 9th page for "Northland's patented RBOP . . . ".
*RPM System, 3000™ Rotating Blowout Preventer: Setting a New Standard in Well Control*, Weatherford, Underbalanced Systems: © 2002-2005 Weatherford; Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford, 28 pages.
Hold™ 2500 RCD Rotating Control Device web page and brochure, http://www.smith.com/hold2500; printed Oct. 27, 2004, 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002).
"Pressured Mud Cap Drilling from a Semi-Submersible Drilling Rig," J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).
Tangedahl, M.J., et al., "Rotating Preventers: Technology for Better Well Control," World Oil, Gulf Publishing Company, Houston, TX, US, vol. 213, No. 10, Oct. 1992, numbered pages 63-64 and 66 (3 pages).
European Search Report for EP 05 27 0083, Application No. 05270083.8-2315, European Patent Office, Mar. 2, 2006, corresponding to U.S. Appl. No. 10/995,980, published as US2006/0108119 A1 (now U.S. Pat. No. 7,487,837 B2) (5 pages)
Netherlands Search Report for NL No. 1026044, dated Dec. 14, 2005 (3 pages).
Int'l Search Report for PCT/GB 00/00731 corresponding to :U.S. Pat. No. 6,470,975 (Jun. 16, 2000) (2 pages).
GB0324939.8 Examination Report corresponding to U.S. Pat. No. 6,470,975 (Mar. 21, 2006) (6 pages).
GB0324939.8 Examination Report corresponding to U.S. Pat. No. 6,470,975 Jan. 22, 2004) (3 pages).
2003/0106712 Family Lookup Report (Jun. 15, 2006) (5 pages).
6,470,975 Family Lookup Report (Jun. 15, 2006) (5 pages).
AU S/N 28183/00 Examination Report corresponding to U.S. Pat. No. 6,470,975 (1 page) (Sep. 9, 2002).
NO S/N 20013953 Examination Report corresponding to U.S. Pat. No. 6,470,975 w/one page of English translation (3 pages) (Apr. 29, 2003).
Nessa, D.O. & Tangedahl, M.L. & Saponia, J: Part 1: "Offshore underbalanced drilling system could revive field developments," World Oil, vol. 218, No. 7, Cover Page, 3, 61-64 and 66 (Jul. 1997); and Part 2: "Making this valuable reservoir drilling/completion technique work on a conventional offshore drilling platform." World Oil, vol. 218 No. 10, Cover Page, 3, 83, 84, 86 and 88 (Oct. 1997) (see 5A, 5G above and 5I below).
Int'l. Search Report for PCT/GB 00/00731 corresponding to U.S. Pat. No. 6,470,975 (4 pages) (Jun. 27, 2000).
Int'l. Preliminary Examination Report for PCT/GB 00/00731 corresponding to U.S. Pat. No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to U.S. Pat. No. 6,263,982 (1 page) (Sep. 6, 2002).
EU Examination Report for WO 00/906522.8-2315 corresponding to U.S. Pat. No. 6,263,982 (4 pages) (Nov. 29, 2004).
NO S/N 20013952 Examination Report w/two pages of English translation corresponding to U.S. Pat. No. 6,263,982 (4 pages) (Jul. 2, 2005).
PCT/GB00/00726 Int'l. Preliminary Examination Report corresponding to U.S. Pat. No. 6,263,982 (10 pages) (Jun. 26, 2001).
PCT/GB00/00726 Written Opinion corresponding to U.S. Pat. No. 6,263,982 (7 pages) (Dec. 18, 2000).
PCT/GB00/00726 International Search Report corresponding to U.S. Pat. No. 6,263,982 (3 pages (Mar. 2, 1999).
AU S/N 27822/99 Examination Report corresponding to U.S. Pat. No. 6,138,774 (1 page) (Oct. 15, 2001).
EU 99908371.0-1266-US99/03888 European Search Report corresponding to U.S. Pat. No. 6,138,774 (3 pages) (Nov. 2, 2004).
NO S/N 20003950 Examination Report w/one page of English translation corresponding to U.S. Pat. No. 6,138,774 (3 pages) (Nov. 1, 2004).
PCT/US990/03888 Notice of Transmittal of International Search Report corresponding to U.S. Pat. No. 6,138,774 (6 pages) (Aug. 4, 1999).
PCT/US99/03888 Written Opinion corresponding to U.S. Pat. No. 6,138,744 (5 pages) (Dec. 21, 1999).
PCT/US99/03888 Notice of Transmittal of International Preliminary Examination Report corresponding to U.S. Pat. No. 6,138,774 (15 pages) (Jun. 12, 2000).
EU Examination Report for 05270083.8-2315 corresponding to US U.S. Appl. No. 10/995,980, published as US 2006/0108119 A1 (now U.S. Pat. No. 7,487,837 B2) (11 pages) (May 10, 2006).
Tangedahl, M.J., et al. "Rotating Preventers: Technology for Better Well Control," World Oil, Gulf Publishing Company, Houston, TX, US, vol. 213, No. 10, Oct. 1, 1992, numbered pp. 63-64 and 66 (3 pages) XP 000288328 ISSN: 0043-8790 (see YYYY, 5X above).
UK Search Report for Application No. GB 0325423.2, searched Jan. 30, 2004 corresponding to above U.S. Pat. No. 7,404,394 (one page).
UK Examination Report for Application No. GB 0325423.2 (corresponding to above 5Z) (4 pages).
Dietle, Lannie L., et al., Kalsi Seals Handbook, Document. 2137 Revision 1, © 1992-2005 Kalsi Engineering, Inc. of Sugar Land, Texas USA; front and back covers and 164 total pages; in particular forward page ii for "Patent Rights"; Appendix A-6 for Kalsi seal part No. 381-6- and A-10 for Kalsi seal part No. 432-32-. as discussed in U.S. Appl. No. 11/366,078 (now U.S. Pat. No. 7,836,946 B2) at number paragraph 70 and 71.
Fig. 10 and discussion in U.S. Appl. No. 11/366,078, published as US2006/0144622 A1 (now U.S. Pat. No. 7,836,946 B2) of Background of Invention.
Partial European search report R.46 EPC dated Jun. 27, 2007 for European Patent Application EP07103416.9-2315 corresponding to U.S. Appl. No. 11/366,078, published as US 2006/0144622 A1, now U.S. Pat. No. 7,836,946 (5 pages).
Extended European search report R.44 EPC dated Oct. 9, 2007 for European Patent Application 07103416.9-2315 corresponding to U.S. Appl. No. 11/366,078, published as US-2006/0144622 A1, now U.S. Pat. No. 7,836,946 (8 pages).
U.S. Appl. No. 60/079,641, Mudlift System for Deep Water Drilling, filed Mar. 27, 1998, abandoned, but priority claimed in above U.S. Pat. No. 6,230,824 B1 and U.S. Pat. No. 6,102,673 and PCT WO-99/50524 (54 pages).
U.S. Appl. No. 60/122,530, Concepts for the Application of Rotating Control Head Technology to Deepwater Drilling Operations, filed Mar. 2, 1999, abandoned, but priority claimed in above U.S. Pat. No. 6,470,975 B1 (54 pages).
PCT/GB2008/050239 (corresponding to US2008/0210471 A1; now issued as U.S. Pat. No. 7,926,593) Annex to Form PCT/ISA/206 Communication Relating to the Results of the Partial International Search dated Aug. 26, 2008 (4 pages).
PCT/GB2008/050239 (corresponding to US2008/0210471 A1; now issued as U.S. Pat. No. 7,926,593) International Search Report and Written Opinion of the International Searching Authority (19 pages).
Vetco Gray Product Information CDE-PI-0007 dated Mar. 1999 for 59.0' Standard Bore CSO Diverter (2 pages) © 1999 by Vetco Gray Inc.
Vetco Gray Capital Drilling Equipment KFDJ and KFDJ Model "J" Diverters (1 page) (no date).
Hydril Blowout Preventers Catalog M-9402 D (44 pages) © 2004 Hydrill Company LP; see annular and ram BOP seals on p. 41.
Hydril Compact GK® 7 1/16'—3000 & 5000 psi Annular Blowout Preventers, Catalog 9503B © 1999 Hydril Company (4 pages).

(56) References Cited

OTHER PUBLICATIONS

Weatherford Controlled Pressure Drilling *Williams*® Rotating Marine Diverter Insert (2 pages).
Weatherford Controlled Pressure Drilling Model 7800 Rotating Control Device © 2007 Weatherford(5 pages).
Weatherford Controlled Pressure Drilling ® and Testing Services *Williams*® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500 ® printed Nov. 24, 2008 (4 pages).
American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint prestentation 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexico OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages); see all but particularly see Figs. 14-20; cited in 7V below where indicated as "document cited for other reasons".
Turck Works Industrial Automation; Factor 1 Sensing for Metal Detection, cover page, first page and numbered pp. 1.157 to 1.170 (16 pages) (printed in Jan. 2009).
Balluff Sensors Worldwide; Object Detection Catalog Aug. 2009—Industrial Proximity Sensors for Non-Contact Detection of Metallic Targets at Ranges Generally under 50mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages)
Inductive Sensors AC 2-Wire Tubular Sensors, Balluff product catalog pp. 1.109-1.120 (12 pages) (no date).
Inductive Sensors DC-2-Wire Tubular Sensors, Balluff product catalog pp. 1.125-1.136 (12 pages) (no date).
Inductive Sensors Analog Inductive Sensors, Balluff product catalog pp. 1.157-1.170 (14 pages) (no date).
Inductive Sensors DC 3-/4-Wire Inductive Sensors, Balluff product catalog pp. 1.72-1.92 (21 pages).
Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 1996-2010, Space Age Control, Inc., printed Jan. 11, 2009 (7 pages) (www..spaceagecontrol.com/selpt.htm).
Liquid Flowmeters, Omega.com website; printed Jan. 26, 2009 (13 pages).
Super Autochoke—Automatic Pressure Regulation Under All Conditions © 2009 M-I, LLC; MI Swaco website; printed Apr. 2, 2009 (1 page).
Extended European Search Report R.61 EPC dated Sep. 16, 2010 for European Patent Application 08166660.4-1266/2050924 corresponding to U.S. Appl. No. 11/975,554, now US 2009/0101351 A1 (7 pages).
Office Action from the Canadian Intellectual Property Office dated Nov. 13, 2008 for Canadian Application No. 2,580,177 corresponding to U.S. Appl. No. 11/366,078, published as US-2006/0144622 A1, now U.S. Pat. No. 7,836,946 B2 (3 pages).
Response to European Patent Application No. 08719084.9 (corresponding to the present published application US2008/0210471 A1, now issued as U.S. Pat. No. 7,926,593) dated Nov. 16, 2010 (4 pages).
Office Action from the Canadian Intellectual Property Office dated Apr. 15, 2008 for Canadian Application No. 2,527,395 corresponding to U.S. Appl. No. 10/995,980, published as US-2006/0108119 A1, now U.S. Pat. No. 7,487,837 B2 (3 pages).
Office Action from the Canadian Intellectual Property Office dated Apr. 9, 2009 for Canadian Application No. 2,527,395 corresponding to U.S. Appl. No. 10/995,980, published as US-2006/0108119 A1, now U.S. Pat. No. 7,487,837 B2 (2 pages).
Office Action from the Canadian Intellectual Property Office dated Dec. 15, 2009 for Canadian Application No. 2,681,868 corresponding to U.S. Appl. No. 10/995,980, published as US-2006/0108119 A1, now U.S. Pat. No. 7,487,837 B2 (2 pages).
Examiner's First Report on Australian Patent Application No. 2005234651 from the Australian Patent Office dated Jul. 22, 2010 corresponding to U.S. Appl. No. 10/995,980, published as US-2006/0108119 A1 now U.S. Pat. No. 7,487,837 B2 (2 pages).
Office Action from the Canadian Intellectual Property Office dated Sep. 9, 2010 for Canadian Application No. 2,707,738 corresponding to U.S. Appl. No. 10/995,980, published as US-2006/0108119 A1, now U.S. Pat. No. 7,487,837 B2 (2 pages).
Web page of Ace Wire Spring & Form Company, Inc. printed Dec. 8, 2009 for "Garter Springs—Helical Extension & Compression" www..acewirespring.com/garter-springs.html (1 page).
Extended European Search Report (R 61 EPC) dated Mar. 4, 2011 for European Application No. 08166658.8-1266/2053197 corresponding to U.S. Appl. No. 11/975,946, published as US 2009-0101411 A1 (13 pages).
Canadian Intellectual Property Office Office Action dated Dec. 7, 2010, Application No. 2,641,238 entitled "Fluid Drilling Equipment" for Canadian Application corresponding to U.S. Appl. No. 11/975,946, published as US 2009-0101411 A1 (4 pages).
Grosso, J.A., "An Analysis of Well Kicks on Offshore Floating Drilling Vessels," SPE 4134, Oct. 1972, pp. 1-20, © 1972 Society of Petroleum Engineers (20 pages).
Bourgoyne, Jr., Adam T., et al., "Applied Drilling Engineering," pp. 168-171, © 1991 Society of Petroleum Engineers (6 pages).
Wagner, R.R., et al., "Surge Field Tests Highlight Dynamic Fluid Response," SPE/IADC 25771, Feb. 1993, pp. 883-892, © 1993 SPE/IADC Drilling Conference (10 pages).
Solvang, S.A., et al., "Managed Pressure Drilling Resolves Pressure Depletion Related Problems in the Development of the HPHT Kristin Field," SPE/IADC 113672, Jan. 2008, pp. 1-9, © 2008 IADC/SPE Managed Pressure Drilling and Underbalanced Operations Conference and Exhibition (9 pages).
Rasmussen, Ovle Sunde, et al., "Evaluation of MPD Methods for Compensation of Surge-and-Swab Pressures in Floating Drilling Operations," IADC/SPE 108346, Mar. 2007, pp. 1-11, © 2007 IADC/SPE Managed Pressure Drilling and Underbalanced Operations Conference and Exhibition (11 pages).

(56) References Cited

OTHER PUBLICATIONS

Shaffer Drill String Compensator available from National Oilwell Varco of Houston, Texas, printed Mar. 23, 2010 from http://www.nov.com/ProductDisplay.aspx?ID=4954&taxID=121 &terms=drill+string+compensators (1 page).
Shaffer Crown Mounted Compensator available from National Oilwell Varco of Houston, Texas, printed Mar. 23, 2010 from http://www.nov.com/ProductDisplay.aspx?ID=4949&taxID=121 &terms=active+drill+strinq+compensator (3 pages).
Active heave compensator available from National Oilwell Varco of Houston, Texas, printed Mar. 23, 2010 from http://www.nov.com/ProductDisplay.aspx?ID=3677&,taxID=740 &terms=active+heave+compensator (3 pages).
Durst, Doug, et al., "Subsea Downhole Motion Compensator (SDMC): Field History, Enhancements, and the Next Generation," IADC/SPE 59152, Feb. 2000, pp. 1-12, © 2000 Society of Petroleum Engineers, Inc. (12 pages).
Sensoy, Taner, et al., Weatherford Secure Drilling Well Controlled Report "Surge and Swab effects due to the Heave motion of floating rigs", Nov. 10, 2009 (7 pages).
Hargreaves, David, et al., "Early Kick Detection for Deepwater Drilling: New Probabilistic Methods Applied in the Field", SPE 71369, © 2001, Society of Petroleum Engineers, Inc. (11 pages).
HH Heavy-Duty Hydraulic Cylinders catalog, The Sheffer Corporation, printed Mar. 5, 2010 from http://www.sheffercorp.com/layout_contact.shtm (27 pages).
Unocal Baroness Surface Stack Upgrade Modifications (5 pages).
Thomson, William T., Professor of Engineering, University of California, "Vibration Theory and Applications", © 1848, 1953, 1965 by Prentice-Hall, Inc. title page, copyright page, contents page and numbered pp. 3-9 (10 pages).
Active Heave Compensator, Ocean Drilling Program, www.oceandrilling.org (3 pages).
3.3 Floating Offshore Drilling Rigs (Floaters); 3.3.1. Technologies Required by Floaters; 3.3.2. Drillships; 3.3.3. Semisubmersible Drilling Rig; 4.3.4. Subsea Control System; 4.4. Prospect of Offshore Production System (5 pages).
Weatherford ® Real Results First Rig Systems Solutions for Thailand Provides Safer, More Efficient Operations with Stabmaster ® and Automated Side Doors, © 2009 Weatherford document No. 6909.00 discussing Weatherford's Integrated Safety Interlock System (ISIS) (1 page).
U.S. Appl. No. 61/205,209 filed Jan. 15, 2009; Abandoned, but priority claimed in US2010/0175882A1 (24 pages).
Australian Intellectual Property Office Patent Examination Report No. 1 dated Nov. 26, 2012, Application No. 2011201664 entitled "System and Method for Managing Heave Pressure from a Floating Rig" for Australian Application corresponding to U.S. Appl. No. 12/761,714, published as US-2011-0253445-A1, now issued as U.S. Pat. No. 8,347,982 on Jan. 8, 2013 (3 pages).
Canadian Intellectual Property Office Office Action dated Oct. 15, 2012, Application No. 2,737,172 entitled "System and Method for Managing Heave Pressure from a Floating Rig" for Canadian Application corresponding to U.S. Appl. No. 12/761,714, published as US-2011-0253445-A1, now issued as U.S. Pat. No. 8,347,982 on Jan. 8, 2013 (2 pages).
Extended European Search Report for European Application No. 11162891.3-1610/Patent 2378056, European Patent Office mailed on May 21, 2013, corresponding to U.S. Appl. No. 12/761,714, published as 2011-0253445 A1 (now U.S. Pat. No. 8,347,982 B2), the parent application for the application U.S. Appl. No. 13/735,303 (our matter 76) (7 pages).
USPTO Non-Final Office Action dated Jul. 3, 2014 corresponding to U.S. Appl. No. 13/428,935, published as US-2012-0241163 A1 on Sep. 27, 2012, rejecting claims as being unpatentable over Hannegan et al. (U.S. Pat. No. 8,347,982) (21 pages) (see NPLs 8T, 8U, and 8V).
Response to USPTO Non-Final Office Action dated Jul. 3, 2014 corresponding to U.S. Appl. No. 13/428,935, published as US-2012-0241163 A1 on Sep. 27, 2012 (8 pages) (see NPLs 8S, 8U, and 8V).
USPTO Final Office Action dated Dec. 23, 2014 corresponding to U.S. Appl. No. 13/428,935, published as US-2012-0241163 A1 on Sep. 27, 2012, rejecting claims as being unpatentable over Hannegan et al. (U.S. Pat. No. 8,347,982) (14 pages) (see NPLs 8S, 8T, and 8V).
Response to USPTO Final Office Action dated Dec. 23, 2014 corresponding to U.S. Appl. No. 13/428,935, published as US-2012-0241163 A1 on Sep. 27, 2012 (9 pages) (see NPLs 8S, 8T, and 8U).
Plaintiffs' Original Petition filed in Texas District Court, Harris County, Cause No. 2014-06763, Court 127 on Feb. 12, 2014; Parties involved are: Plaintiffs, Secure Drilling, L.P. and Secure Drilling International, L.P. (Weatherford Holdings UK is the parent company of Secure Drilling, L.P. and Secure Drilling International, L.P.), and Defendants, Dr. Helio Mauricio Ribeiro Dos Santos, Safekick Americas, LLC, and Safekick Ltd.; this lawsuit relates to ownership of U.S. Pat. No. 8,528,660 and U.S. Appl. No. 12/854,674 and its corresponding PCT Application No. PCT/US2011/047404, published as WO/2012/021693 on Feb. 16, 2012 (19 pages).
Partial European Search Report R.46 EPC dated Mar. 23, 2015 for European Patent Application EP 14190305.4, corresponding to the parent U.S. Appl. No. 12/761,714, published as US 2011/0253445 A1, now U.S. Pat. No. 8,347,982 B2 (our matter 66) (7 pages).
Request for Continued Examination (RCE) filed May 19, 2015 for a Response to an Advisory Action dated Mar. 23, 2015 and a Final Office Action dated Dec. 23, 2014 for U.S. Appl. No. 13/428,935, published as US-2012-0241163 A1 on Sep. 27, 2012 (13 pages).
Notice of Allowance and Fee(s) Due mailed Jun. 22, 2015 by the U.S. Patent and Trademark Office for U.S. Appl. No. 13/428,935, resulting from RCE filed on May 19, 2015 (see NPL 8Y) (5 pages).
Request for Continued Examination (RCE) filed Aug. 5, 2015 for an Information Disclosure Statement submitting a letter dated Jul. 22, 2015 from Strasburger & Price, LLP regarding statements that Smith made in the May 19$^{th}$ Amendment (NPL 8Y) related to U.S. Pat. No. 8,347,982 B2, assigned to Weatherford/Lamb, Inc. for U.S. Appl. No. 13/428,935 (8 pages).
Extended European Search Report for European Application No. 14190305.4-1610/Patent 2845994, mailed on Jul. 13, 2015 from the European Patent Office, corresponding to the parent U.S. Appl. No. 12/761,714 (now U.S. Pat. No. 8,347,982 B2) (our matter 66) and U.S. Appl. No. 13/735,303 (now U.S. Pat. No. 8,863,858 B2) (our matter 76)(11 pages).
USPTO Non-Final Office Action mailed Sep. 24, 2015 for U.S. Appl. No. 13/428,935, published as US-2012-0241163 A1 on Sep. 27, 2012 (see NPLs 8S, 8T, 8U, 8V, 8Y, 8Z, and 9A previously submitted) (6 pages).

* cited by examiner

SYSTEM AND METHOD FOR MANAGING HEAVE PRESSURE FROM A FLOATING RIG

CROSS-REFERENCE TO RELATED APPLICATIONS

This application is a continuation of U.S. application Ser. No. 13/735,303 filed on Jan. 7, 2013, now U.S. Pat. No. 8,863,858, which is a continuation of U.S. application Ser. No. 12/761,714 filed Apr. 16, 2010, now U.S. Pat. No. 8,347,982, which applications are hereby incorporated by reference for all purposes in their entirety and are assigned to the assignee of the present invention.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to conventional and/or managed pressure drilling from a floating rig.

2. Description of the Related Art

Rotating control devices (RCDs) have been used in the drilling industry for drilling wells. An internal sealing element fixed with an internal rotatable member of the RCD seals around the outside diameter of a tubular and rotates with the tubular. The tubular may be a drill string, casing, coil tubing, or any connected oilfield component. The tubular may be run slidingly through the RCD as the tubular rotates, or when the tubular is not rotating. Examples of some proposed RCDs are shown in U.S. Pat. Nos. 5,213,158; 5,647,444 and 5,662,181.

RCDs have been proposed to be positioned with marine risers. An example of a marine riser and some of the associated drilling components is proposed in U.S. Pat. No. 4,626,135. U.S. Pat. No. 6,913,092 proposes a seal housing with a RCD positioned above sea level on the upper section of a marine riser to facilitate a mechanically controlled pressurized system. U.S. Pat. No. 7,237,623 proposes a method for drilling from a floating structure using an RCD positioned on a marine riser. Pub. No. US 2008/0210471 proposes a docking station housing positioned above the surface of the water for latching with an RCD. U.S. Pat. Nos. 6,470,975; 7,159,669; and 7,258,171 propose positioning an RCD assembly in a housing disposed in a marine riser. An RCD has also been proposed in U.S. Pat. No. 6,138,774 to be positioned subsea without a marine riser.

U.S. Pat. Nos. 3,976,148 and 4,282,939 proposes methods for determining the flow rate of drilling fluid flowing out of a telescoping marine riser that moves relative to a floating vessel heave. U.S. Pat. No. 4,291,772 proposes a method and apparatus to reduce the tension required on a riser by maintaining a pressure on a lightweight fluid in the riser over the heavier drilling fluid.

Latching assemblies have been proposed in the past for positioning an RCD. U.S. Pat. No. 7,487,837 proposes a latch assembly for use with a riser for positioning an RCD. Pub. No. US 2006/0144622 proposes a latching system to latch an RCD to a housing. Pub. No. US 2009/0139724 proposes a latch position indicator system for remotely determining whether a latch assembly is latched or unlatched.

In more recent years, RCDs have been used to contain annular fluids under pressure, and thereby manage the pressure within the wellbore relative to the pressure in the surrounding earth formation. In some circumstances, it may be desirable to drill in an underbalanced condition, which facilitates production of formation fluid to the surface of the wellbore since the formation pressure is higher than the wellbore pressure. U.S. Pat. No. 7,448,454 proposes underbalanced drilling with an RCD. At other times, it may be desirable to drill in an overbalanced condition, which helps to control the well and prevent blowouts since the wellbore pressure is greater than the formation pressure. While Pub. No. US 2006/0157282 generally proposes Managed Pressure Drilling (MPD), International Pub. No. WO 2007/092956 proposes MPD with an RCD. MPD is an adaptive drilling process used to control the annulus pressure profile throughout the wellbore. The objectives are to ascertain the downhole pressure environment limits and to manage the hydraulic annulus pressure profile accordingly.

One equation used in the drilling industry to determine the equivalent weight of the mud and cuttings in the wellbore when circulating with the rig mud pumps on is:

Equivalent Mud Weight(EMW)=Mud Weight Hydrostatic Head+Δ Circulating Annulus Friction Pressure(AFP)

This equation would be changed to conform the units of measurements as needed. In one variation of MPD, the above Circulating Annulus Friction Pressure (AFP), with the rig mud pumps on, is swapped for an increase of surface backpressure, with the rig mud pumps off, resulting in a Constant Bottomhole Pressure (CBHP) variation of MPD, or a constant EMW, whether the mud pumps are circulating or not. Another variation of MPD is proposed in U.S. Pat. No. 7,237,623 for a method where a predetermined column height of heavy viscous mud (most often called kill fluid) is pumped into the annulus. This mud cap controls drilling fluid and cuttings from returning to surface. This pressurized mud cap drilling method is sometimes referred to as bull heading or drilling blind.

The CBHP MPD variation is achieved using non-return valves (e.g., check valves) on the influent or front end of the drill string, an RCD and a pressure regulator, such as a drilling choke valve, on the effluent or back return side of the system. One such drilling choke valve is proposed in U.S. Pat. No. 4,355,784. A commercial hydraulically operated choke valve is sold by M-I Swaco of Houston, Tex. under the name SUPER AUTOCHOKE. Also, Secure Drilling International, L.P. of Houston, Tex., now owned by Weatherford International, Inc., has developed an electronic operated automatic choke valve that could be used with its underbalanced drilling system proposed in U.S. Pat. Nos. 7,044,237; 7,278,496; 7,367,411 and 7,650,950. In summary, in the past, an operator of a well has used a manual choke valve, a semi-automatic choke valve and/or a fully automatic choke valve for an MPD program.

Generally, the CBHP MPD variation is accomplished with the drilling choke valve open when circulating and the drilling choke valve closed when not circulating. In CBHP MPD, sometimes there is a 10 choke-closing pressure setting when shutting down the rig mud pumps, and a 10 choke-opening setting when starting them up. The mud weight may be changed occasionally as the well is drilled deeper when circulating with the choke valve open so the well does not flow. Surface backpressure, within the available pressure containment capability rating of an RCD, is used when the pumps are turned off (resulting in no AFP) during the making of pipe connections to keep the well from flowing. Also, in a typical CBHP application, the mud weight is reduced by about 0.5 ppg from conventional drilling mud weight for the similar environment. Applying the above EMW equation, the operator navigates generally within a shifting drilling window, defined by the pore pressure and fracture pressure of the formation, by swapping surface backpressure, for when the pumps are off and the AFP is eliminated, to achieve CBHP.

The CBHP variation of MPD is uniquely applicable for drilling within narrow drilling windows between the formation pore pressure and fracture pressure by drilling with precise management of the wellbore pressure profile. Its key characteristic is that of maintaining a constant effective bottomhole pressure whether drilling ahead or shut in to make jointed pipe connections. CBHP is practiced with a closed and pressurizable circulating fluids system, which may be viewed as a pressure vessel. When drilling with a hydrostatically underbalanced drilling fluid, a predetermined amount of surface backpressure must be applied via an RCD and choke manifold when the rig's mud pumps are off to make connections.

While making drill string or other tubular connections on a floating rig, the drill string or other tubular is set on slips with the drill bit lifted off the bottom. The mud pumps are turned off. During such operations, ocean wave heave of the rig may cause the drill string or other tubular to act like a piston moving up and down within the "pressure vessel" in the riser below the RCD, resulting in fluctuations of wellbore pressure that are in harmony with the frequency and magnitude of the rig heave. This can cause surge and swab pressures that will effect the bottom hole pressures and may in turn lead to lost circulation or an influx of formation fluid, particularly in drilling formations with narrow drilling windows. Annulus returns may be displaced by the piston effect of the drill string heaving up and down within the wellbore along with the rig.

The vertical heave caused by ocean waves that have an average time period of more than 5 seconds have been reported to create surge and swab pressures in the wellbore while the drill string is suspended from the slips. See GROSSO, J. A., "An Analysis of Well Kicks on Offshore Floating Drilling Vessels," SPE 4134, October 1972, pages 1-20, © 1972 Society of Petroleum Engineers. The theoretical surge and swab pressures due to heave motion may be calculated using fluid movement differential equations and average drilling parameters. See BOURGOYNE, JR., ADAM T., et al, "Applied Drilling Engineering," pages 168-171, © 1991 Society of Petroleum Engineers.

In benign seas of less than a few feet of wave heave, the ability of the CBHP MPD method to maintain a more constant equivalent mud weight is not substantially compromised to a point of non-commerciality. However, in moderate to rough seas, it is desirable that this technology gap be addressed to enable CBHP and other variations of MPD to be practiced in the world's bodies of water where it is most needed, such as deep waters where wave heave may approach 30 feet (9.1 m) or more and where the geologic formations have narrow drilling windows. A vessel or rig heave of 30 feet (peak to valley and back to peak) with a 6⅝ inch (16.8 cm) diameter drill string may displace about 1.3 barrels of annulus returns on the heave up, and the same amount on heave down. Although the amount of fluid may not appear large, in some wellbore geometries it may cause pressure fluctuations up to 350 psi.

Studies show that pulling the tubular with a velocity of 0.5 m/s creates a swab effect of 150 to 300 psi depending on the bottomhole assembly, casing, and drilling fluid configuration. See WAGNER, R. R. et al., "Surge Field Tests Highlight Dynamic Fluid Response," SPE/IADC 25771, February 1993, pages 883-892, © 1993 SPE/IADC Drilling Conference. One deepwater field in the North Sea reportedly faced heave effects between 75 to 150 psi. See SOLVANG, S. A. et al., "Managed Pressure Drilling Resolves Pressure Depletion Related Problems in the Development of the HPHT Kristin Field," SPE/IADC 113672, January 2008, pages 1-9, © 2008 IADC/SPE Managed Pressure Drilling and Underbalanced Operations Conference and Exhibition. However, there are depleted reservoirs and deepwater prospects, such as in the North Sea, offshore Brazil, and elsewhere, where the pressure fluctuation from wave heaving must be lowered to 15 psi to stay within the narrow drilling window between the fracture and the pore pressure gradients. Otherwise, damage to the formation or a well kick or blow out may occur.

The problem of maintaining a bottomhole pressure (BHP) within acceptable limits in a narrow drilling window when drilling from a heaving Mobile Offthore Drilling Unit (MODU) is discussed in RASMUSSEN, OVLE SUNDE et al, "Evaluation of MPD Methods for Compensation of Surge-and-Swab Pressures in Floating Drilling Operations," IADC/SPE 108346, March 2007, pages 1-11, © 2007 IADC/SPE Managed Pressure Drilling and Underbalanced Operations Conference and Exhibition. One proposed solution when using drilling fluid with density less than the pore pressure gradient is a continuous circulation method in which drilling fluid is continuously circulated through the drill string and the annulus during tripping and drill pipe connection. An identified disadvantage with the method is that the flow rate must be rapidly and continuously adjusted, which is described as likely to be challenging. Otherwise, fracturing or influx is a possibility. Another proposed solution using drilling fluid with density less than the pore pressure gradient is to use an RCD with a choke valve for back pressure control. However, again a rapid system response is required to compensate for the rapid heave motions, which is difficult in moderate to high heave conditions and narrow drilling windows.

A proposed solution when using drilling fluid with density greater than the pore pressure is a dual gradient drilling fluid system with a subsea mud lift pump, riser, and RCD. Another proposed solution when using drilling fluid with density greater than the pore pressure is a single gradient drilling fluid system with a subsea mud lift pump, riser, and RCD. A disadvantage with both methods is that a rapid response is required at the fluid level interface to compensate for pressure. Subsea mud lift systems utilizing only an adjustable mud/water or mud/air level in the riser will have difficulty controlling surge and swab effects. Another disadvantage is the high cost of a subsea pump operation.

The authors in the above IADC/SPE 108346 technical paper conclude that given the large heave motion of the MODU (±2 to 3 m), and the short time between surge and swab pressure peaks (6 to 7 seconds), it may be difficult to achieve complete surge and swab pressure compensation with any of the proposed methods. They suggest that a real-time hydraulics computer model is required to control wellbore pressures during connections and tripping. They propose that the capability of measuring BHP using a wired drill string telemetry system may make equivalent circulating density control easier, but when more accurate control of BHP is required, the computer model will be needed to predict the surge and swab pressure scenarios for the specific conditions. However, such a proposed solution presents a formidable task given the heave intervals of less than 30 seconds, since even programmable logic controller (PLC) controlled chokes consume that amount of time each heave direction to receive measurement while drilling (MWD) data, interpreting it, instructing a choke setting, and then reacting to it.

International Pub. No. WO 2009/123476 proposes that a swab pressure may be compensated for by increasing the opening of a subsea bypass choke valve to allow hydrostatic pressure from a subsea lift pump return line to be applied to increase pressure in the borehole, and that a surge pressure may be compensated for by decreasing the opening of the subsea bypass choke valve to allow the subsea lift pump to reduce the pressure in the borehole. The '476 publication admits that compensating for surge and swab pressure is a challenge on a MODU, and it proposes that its method is feasible if given proper measurements of the rig heave motion, and predictive control. However, accurate measurements are difficult to obtain and then respond to, particularly in such a short time frame. Moreover, predictive control is difficult to achieve, since rogue waves or other unusual wave conditions, such as induced by bad weather, cannot be predicted with accuracy. U.S. Pat. No. 5,960,881 proposes a system for reducing surge pressure while running a casing liner.

Wave heave induced pressure fluctuations also occur during tripping the drill string out of and returning it to the wellbore. When surface backpressure is being applied while tripping from a floating rig, such as during deepwater MPD, each heave up is an additive to the tripping out speed, and each heave down is an additive to the tripping in speed. Whether tripping in or out, these heave-related accelerations of the drill string must be considered. Often, the result is slower than desired tripping speeds to avoid surge-swab effects. This can create significant delays, particularly with deepwater rigs commanding rental rates of $500,000 per day.

The problem of maintaining a substantially constant pressure may also exist in certain applications of conventional drilling with a floating rig. In conventional drilling in deepwater with a marine riser, the riser is not pressurized by mechanical devices during normal operations. The only pressure induced by the rig operator and contained by the riser is that generated by the density of the drilling mud held in the riser (hydrostatic pressure). A typical marine riser is 21¼ inches (54 cm) in diameter and has a maximum pressure rating of 500 psi. However, a high strength riser, such as a 16 inch (40.6 cm) casing with a pressure rating around 5000 psi, known as a slim riser, may be advantageously used in deepwater drilling. A surface BOP may be positioned on such a riser, resulting in lower maintenance and routine stack testing costs.

To circulate out a kick and also during the time mud density changes are being made to get the well under control, the drill bit is lifted off bottom and the annular BOP closed against the drill string. The annular BOP is typically located over a ram-type BOP. Ram type blow out preventers have also been proposed in the past for drilling operations, such as proposed in U.S. Pat. Nos. 4,488,703; 4,508,313; 4,519,577; and 5,735,502. As with annular BOPs, drilling must cease when the internal ram BOP seal is closed or sealed against the drill string, or seal wear will occur. When floating rigs are used, heave induced pressure fluctuations may occur as the drill string or other tubular moves up and down notwithstanding the seal against it from the annular BOP. The annular BOP is often closed for this purpose rather than the ram-type BOP in part because the annular BOP seal inserts can be more easily replaced after becoming worn. The heave induced pressure fluctuations below the annular BOP seal may destabilize an un-cased hole on heave down (surge), and suck in additional influx on heave up (swab).

There appears to be a general consensus that the use of deepwater floating rigs with surface BOPs and slim risers presents a higher risk of the kick coming to surface before a BOP can be closed. With the surface BOP annular seal closed, it sometimes takes hours to circulate out riser gas. Significant heaving on intervals such as 30 seconds (peak to valley and back to peak) may cause or exacerbate many time consuming problems and complications resulting therefrom, such as (1) rubble in the wellbore, (2) out of gauge wellbore, and (3) increased quantities of produced-to-surface hydrocarbons. Wellbore stability may be compromised.

Drill string motion compensators have been used in the past to maintain constant weight on the drill bit during drilling in spite of oscillation of the floating rig due to wave motion. One such device is a bumper sub, or slack joint, which is used as a component of a drill string, and is placed near the top of the drill collars. A mandrel composing an upper portion of the bumper sub slides in and out of a body of the bumper sub like a telescope in response to the heave of the rig, and this telescopic action of the bumper sub keeps the drill bit stable on the wellbore during drilling. However, a bumper sub only has a maximum 5 foot (1.5 m) stroke range, and its 37 foot (11.3 m) length limits the ability to stack bumper subs in tandem or in triples for use in rough seas.

Drill string heave compensator devices have been used in the past to decrease the influence of the heave of a floating rig on the drill string when the drill bit is on bottom and the drill string is rotating for drilling. The prior art heave compensators attempt to keep a desired weight on the drill bit while the drill bit is on bottom and drilling. A passive heave compensator known as an in-line compensator may consist of one or more hydraulic cylinders positioned between the traveling block and hook, and may be connected to the deck-mounted air pressure vessels via standpipes and a hose loop, such as the Shaffer Drill String Compensator available from National Oilwell Varco of Houston, Tex.

The passive heave compensator system typically compensates through hydro-pneumatic action of compressing a volume of air and throttling of fluid via cylinders and pistons. As the rig heaves up or down, the set air pressure will support the weight corresponding to that pressure. As the drilling gets deeper and more weight is added to the drill string, more pressure needs to be added. A passive crown mounted heave compensator may consist of vertically mounted compression-type cylinders attached to a rigid frame mounted to the derrick water table, such as the Shaffer Crown Mounted Compensator also available from National Oilwell Varco of Houston, Tex. Both the in-line and crown mounted heave compensators use either hydraulic or pneumatic cylinders that act as springs supporting the drill string load, and allow the top of the drill string to remain stationary as the rig heaves. Passive heave compensators may be only about 45% efficient in mild seas, and about 85% efficient in more violent seas, again while the drill bit is on bottom and drilling.

An active heave compensator may be a hydraulic power assist device to overcome the passive heave compensator seal friction and the drill string guide horn friction. An active system may rely on sensors (such as accelerometers), pumps and a processor that actively interface with the passive heave compensator to maintain the weight needed on the drill bit while on bottom and drilling. An active heave compensator may be used alone, or in combination with a passive heave compensator, again when the drill bit is on bottom and the drill string is rotating for drilling. An active heave compensator is available from National Oilwell Varco of Houston, Tex.

A downhole motion compensator tool, known as the Subsea Downhole Motion Compensator (SDMC™) available from Weatherford International, Inc. of Houston, Tex., has been successfully used in the past in numerous milling operations. SDMC™ is a trademark of Weatherford International, Inc. See DURST, DOUG et al, "Subsea Downhole Motion Compensator: Field History, Enhancements, and the Next Generation," IADC/SPE 59152, February 2000, pages 1-12, © 2000 Society of Petroleum Engineers Inc. The authors in the above technical paper IADC/SPE 59152 report that although semisubmersible drilling vessels may provide active rig-heave equipment, residual heave is expected when the seas are rough. The authors propose that rig-motion compensators, which operate when the drill bit is drilling, can effectively remove no more than about 90% of heave motion. The SDMC™ motion compensator tool is installed in the work string that is used for critical milling operations, and lands in or on either the wellhead or wear bushing of the wellhead. The tool relies on slackoff weight to activate miniature metering flow regulators that are contained within a piston disposed in a chamber. The tool contains two hydraulic cylinders, with metering devices installed in the piston sections. U.S. Pat. Nos. 6,039,118 and 6,070,670 propose downhole motion compensator tools.

Riser slip joints have been used in the past to compensate for the vertical movement of the floating rig on the riser, such as proposed in FIG. 1 of both U.S. Pat. Nos. 4,282,939 and 7,237,623. However, when a riser slip joint is located within the "pressure vessel" in the riser below the RCD, its telescoping movement may result in fluctuations of wellbore pressure much greater than 350 psi that are in harmony with the frequency and magnitude of the rig heave. This creates problems with MPD in formations with narrow drilling windows, particularly with the CBHP variation of MPD.

The above discussed U.S. Pat. Nos. 3,976,148; 4,282,939; 4,291,772; 4,355,784; 4,488,703; 4,508,313; 4,519,577; 4,626,135; 5,213,158; 5,647,444; 5,662,181; 5,735,502; 5,960,881; 6,039,118; 6,070,670; 6,138,774; 6,470,975; 6,913,092; 7,044,237; 7,159,669; 7,237,623; 7,258,171; 7,278,496; 7,367,411; 7,448,454; 7,487,837; and 7,650,950; and Pub. Nos. US 2006/0144622; 2006/0157282; 2008/0210471; and 2009/0139724; and International Pub. Nos. WO 2007/092956 and WO 2009/123476 are all hereby incorporated by reference for all purposes in their entirety. U.S. Pat. Nos. 5,647,444; 5,662,181; 6,039,118; 6,070,670; 6,138,774; 6,470,975; 6,913,092; 7,044,237; 7,159,669; 7,237,623; 7,258,171; 7,278,496; 7,367,411; 7,448,454 and 7,487,837; and Pub. Nos. US 2006/0144622; 2006/0157282; 2008/0210471; and 2009/0139724; and International Pub. No. WO 2007/092956 are assigned to the assignee of the present invention.

A need exists when drilling from a floating drilling rig for an approach to rapidly compensate for the change in pressure caused by the vertical movement of the drill string or other tubular when the rig's mud pumps are off and the drill string or tubular is lifted off bottom as joint connections are being made, particularly in moderate to rough seas and in geologic formations with narrow drilling windows between pore pressure and fracture pressure. Also, a need exists when drilling from floating rigs for an approach to rapidly compensate for the heave induced pressure fluctuations when the rig's mud pumps are off the drill string or tubular is lifted off bottom, the annular BOP seal is closed, and the drill string or tubular nevertheless continues to move up and down from wave induced heave on the rig while riser gas is circulated out. Also, a need exists when tripping the drill string into or out of the hole to optimize tripping speeds by canceling the rig heave-related swab-surge effects. Finally, a need exists when drilling from floating rigs for an approach to rapidly compensate for the heave induced pressure fluctuations when the rig's mud pumps are on, the drill bit is on bottom with the drill string or tubular rotating during drilling, and a telescoping joint in the riser located below an RCD telescopes from the heaving.

BRIEF SUMMARY OF THE INVENTION

A system for both conventional and MPD drilling is provided to compensate for heave induced pressure fluctuations on a floating rig when a drill string or other tubular is lifted off bottom and suspended on the rig. When suspended, the tubular moves vertically within a riser, such as when tubular connections are made during MPD, when tripping, or when a gas kick is circulated out during conventional drilling. The system may also be used to compensate for heave induced pressure fluctuations on a floating rig from a telescoping joint located below an RCD when a drill string or other tubular is rotating for drilling. The system may be used to better maintain a substantially constant BHP below an RCD or a closed annular BOP. Advantageously, a method for use of the below system is provided.

In one embodiment, a valve may be remotely activated to an open position to allow the movement of liquid between the riser annulus below an RCD or annular BOP and a flow line in communication with a gas accumulator containing a pressurized gas. A gas source may be in fluid communication with the flow line and/or the gas accumulator through a gas pressure regulator. A liquid and gas interface preferably in the flow line moves as the tubular moves, allowing liquid to move into and out of the riser annulus to compensate for the vertical movement of the tubular. When the tubular moves up, the interface may move further along the flow line toward the riser. When the tubular moves down, the interface may move further along the flow line toward or into the gas accumulator.

In another embodiment, a valve may be remotely activated to an open position to allow the liquid in the riser annulus below an RCD or annular BOP to communicate with a flow line. A pressure relief valve or an adjustable choke connected with the flow line may be set at a predetermined pressure. When the tubular moves down and the set pressure is obtained, the pressure relief valve or choke allows the fluid to move through the flow line toward a trip tank. Alternatively, or in addition, the fluid may be allowed to move through the flow line toward the riser above the RCD or annular BOP. When the tubular moves up, a pressure regulator set at a first predetermined pressure allows the mud pump to move fluid along the flow line to the riser annulus below the RCD or annular BOP. A pressure compensation device, such as an adjustable choke, may also be set at a second predetermined pressure and positioned with the flow line to allow fluid to move past it when the second predetermined pressure is reached or exceeded.

In yet another embodiment, in a slip joint piston method, a first valve may be remotely activated to an open position to allow the liquid in the riser annulus below the RCD or annular BOP to communicate with a flow line. The flow line may be in fluid communication with a fluid container that houses a piston. A piston rod may be attached to the floating rig or the movable barrel of the riser telescoping joint, which is in turn attached to the floating rig. The fluid container may be in fluid communication with the riser annulus above the RCD or annular BOP through a first conduit. The fluid container may also be in fluid communication with the riser annulus above the RCD or annular BOP through a second conduit and second valve. The piston can move in the same direction and the same distance as the tubular to move the required amount of fluid into or out of the riser annulus below the RCD or annular BOP.

In one embodiment of the slip joint piston method, when the tubular moves down, the piston moves down, moving fluid from the riser annulus located below the RCD or annular BOP into the fluid container. When the tubular heaves up, the piston moves up, moving fluid from the fluid container to the riser annulus located below the RCD or annular BOP. A shear member may be used to allow the piston rod to be sheared from the rig during extreme heave conditions. A volume adjustment member may be positioned with the piston in the fluid container to compensate for different tubular and riser sizes.

In another embodiment of the slip joint piston method, a first valve may be remotely activated to an open position to allow the liquid in the riser annulus below the RCD or annular BOP to communicate with a flow line. The flow line may be in fluid communication with a fluid container that houses a piston. The piston rod may be attached to the floating rig or the movable barrel of the riser telescoping joint, which is in turn attached to the floating rig. The fluid container may be in fluid communication with a trip tank through a trip tank conduit. The fluid container may have a fluid container conduit with a second valve. The piston can move in the same direction and the same distance as the tubular to move the required amount of fluid into or out of the riser annulus below the RCD or annular BOP.

Any of the embodiments may be used with a riser having a telescoping joint located below an RCD to compensate for the pressure fluctuations caused by the heaving movement of the telescoping joint when the drill bit is on bottom and drilling. For all of the embodiments, there may be redundancies. Two or more different embodiments may be used together for redundancy. There may be dedicated flow lines, valves, pumps, or other apparatuses for a single function, or there may be shared flow lines, valves, pumps, or apparatuses for different functions.

BRIEF DESCRIPTION OF THE DRAWINGS

A better understanding of the present invention can be obtained with the following detailed descriptions of the various disclosed embodiments in the drawings.

DETAILED DESCRIPTION OF THE INVENTION

The below systems and methods may be used in many different drilling environments with many different types of floating drilling rigs, including floating semi-submersible rigs, submersible rigs, drill ships, and barge rigs. The below systems and methods may be used with MPD, such as with CBHP to maintain a substantially constant BHP, during tripping including drill string connections and disconnections. The below systems and methods may also be used with other variations of MPD practiced from floating rigs, such as dual gradient drilling and pressurized mud cap. The below systems and methods may be used with conventional drilling, such as when the annular BOP is closed to circulate out a kick or riser gas, and also during the time mud density changes are being made to get the well under control, while the floating rig experiences heaving motion. The more compressible the drilling fluid, the more benefit that will be obtained from the below systems and methods when underbalanced drilling. The below systems and methods may also be used with a riser having a telescoping joint located below an RCD to compensate for the pressure fluctuations caused by the heaving movement of the telescoping joint when the drill bit is in contact with the wellbore and drilling. As used herein, drill bit includes, but is not limited to, any device disposed with a drill string or other tubular for cutting or boring the wellbore.

Accumulator System

Figure 1:
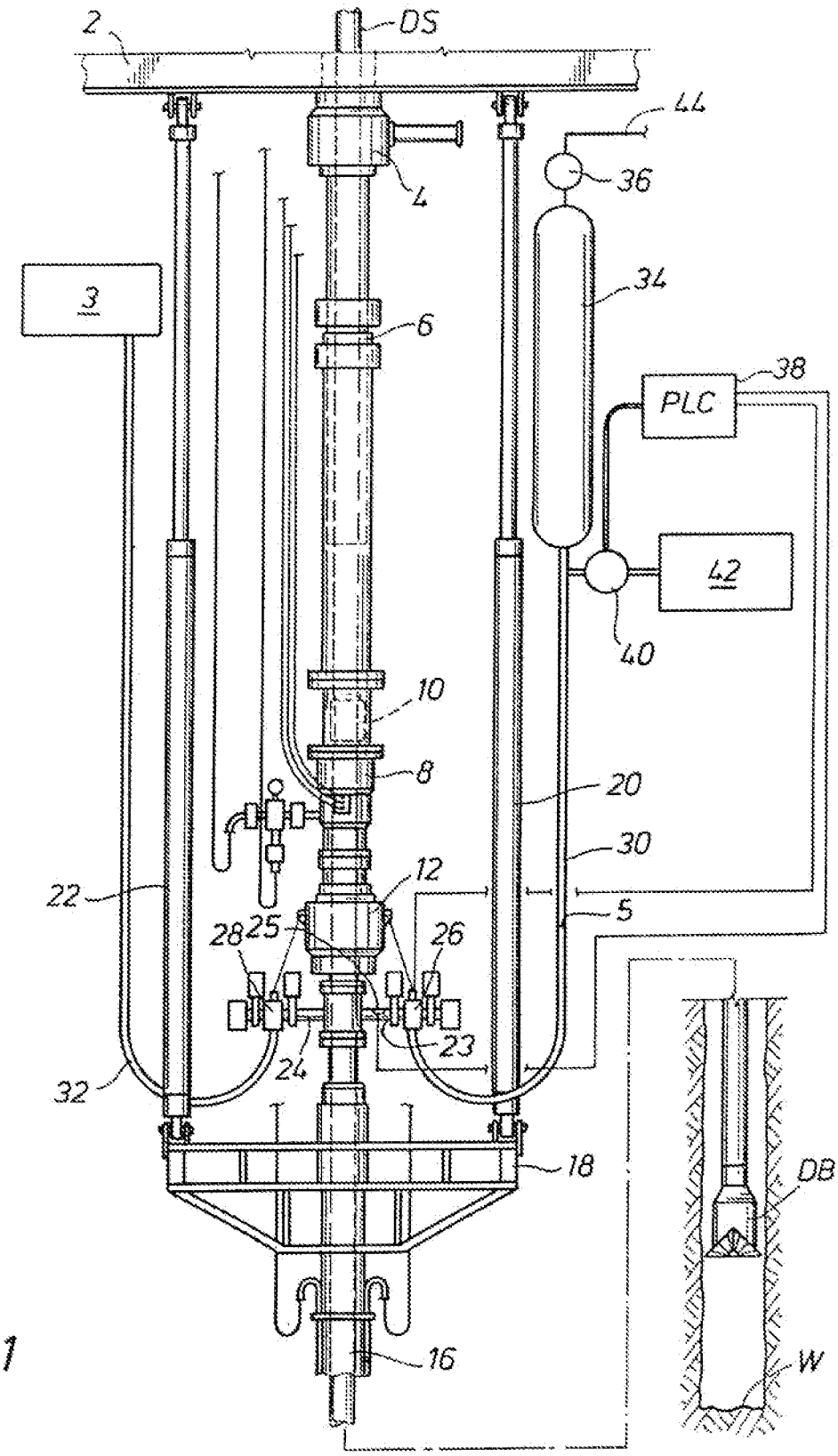
FIG. 1 is an elevational view of a riser with a telescoping or slip joint, an RCD housing with a RCD shown in phantom, an annular BOP, and a drill string or other tubular in the riser with the drill bit spaced apart from the wellbore, and on the right side of the riser a first T-connector with a first valve attached with a first flexible flow line in fluid communication with an accumulator and a gas supply source through a pressure regulator, and on the left side of the riser a second T-connector with a second valve attached with a second flexible flow line connected with a choke manifold.

Turning to FIG. 1, riser tensioner members (20, 22) are attached at one end with beam 2 of a floating rig, and at the other end with riser support member or platform 18. Beam 2 may be a rotary table beam, but other structural support members on the rig are contemplated for FIG. 1 and for all embodiments shown in all the Figures. There may be a plurality of tensioner members (20, 22) positioned between rig beam 2 and support member 18 as is known in the art. Riser support member 18 is positioned with riser 16. Riser tensioner members (20, 22) may put approximately 2 million pounds of tension on the riser 16 to aid it in dealing with subsea currents, and may advantageously pull down on the floating rig to aid its stability. Although only shown in FIG. 1, riser tensioner members (20, 22) and riser support member 18 may be used with all embodiments shown in all of the Figures.

Other riser tension systems are contemplated for all embodiments shown in all of the Figures, such as riser tensioner cables connected to a riser tensioner ring disposed with the riser, such as shown in FIGS. 2-5. Riser tensioner members (20, 22) may also be attached with a riser tensioner ring rather than a support member or platform 18. Returning to FIG. 1, marine diverter 4 is attached above riser telescoping joint 6 below the rig beam 2. Riser telescoping joint 6, like all the telescoping joints shown in all the Figures, may lengthen or shorten the riser, such as riser 16. RCD 10 is disposed in RCD housing 8 over an annular BOP 12. The annular BOP 12 is optional. A surface ram-type BOP is also optional. There may also be a subsea ram-type BOP and/or a subsea annular BOP, which are not shown. RCD housing 8 may be a housing such as the docking station housing in Pub. No. US 2008/0210471 positioned above the surface of the water for latching with an RCD. However, other RCD housings are contemplated, such as the RCD housings disposed in a marine riser proposed in U.S. Pat. Nos. 6,470,975; 7,159,669; and 7,258,171. The RCD 10 may allow for MPD including, but not limited to, the CBHP variation of MPD. Drill string DS is disposed in riser 16 with the drill bit DB spaced apart from the wellbore W, such as when tubular connections are made.

First T-connector 23 extends from the right side of the riser 16, and first valve 26 is disposed with the first T-connector 23 and fluidly connected with first flexible flow line 30. First valve 26 may be remotely actuatable. First valve may be in hardwire connection with a PLC 38. Sensor 25 may be positioned within first T-connector 23, as shown in FIG. 1, or with first valve 26. As shown, sensor 25 may be in hardwire connection with PLC 38. Sensor 25, upon sensing a predetermined pressure or pressure range, may transmit a signal to PLC 38 through the hardwire connection or wirelessly to remotely actuate valve 26 to move the valve to the open position and/or the closed position. Sensor 25 may measure pressure, although other measurements are also contemplated, such as temperature or flow. First flow line 30 may be longer than the flow line or hose to the choke manifold, although other lengths are contemplated. A fluid container or gas accumulator 34 is in fluid communication with first flow line 30. Accumulator 34 may be any shape or size for containing a compressible gas under pressure, but it is contemplated that a pressure vessel with a greater height than width may be used. Accumulator 34 may be a casing closed at both ends, such as a 30 foot (9.1 m) tall casing with 30 inch (76.2 cm) diameter, although other sizes are contemplated. It is contemplated that a bladder may be used at any liquid and gas interface in the accumulator 34 depending on relative position of the accumulator 34 to the first T-connector 23 and if the accumulator 34 height is substantially the same as the width or if the accumulator width is greater than the height. A liquid and gas interface, such as at interface position 5, may be in first flow line 30.

A vent valve 36 may be disposed with accumulator 34 to allow the movement of vent gas or other fluids through vent line 44. A gas source 42 may be in fluid communication with first flow line 30 through a pressure regulator 40. Gas source 42 may provide a compressible gas, such as Nitrogen or air. It is also contemplated that the gas source 42 and/or pressure regulator 40 may be in fluid communication directly with accumulator 34. Pressure regulator 40 may be in hardwire connection with PLC 38. However, pressure regulator 40 may be operated manually, semi-automatically, or automatically to maintain a predetermined pressure. For all embodiments shown in all of the Figures, any connection with a PLC may also be wireless and/or may actively interface with other systems, such as the rig's data collection system and/or MPD choke control systems. Second T-connector 24 extends from the left side of the riser 16, and second valve 28 is fluidly connected with the second T-connector 24 and fluidly connected with second flexible flow line 32, which is fluidly connected with choke manifold 3. It is contemplated that other devices besides a choke manifold 3 may be connected with second flow line 32.

Figure 2:
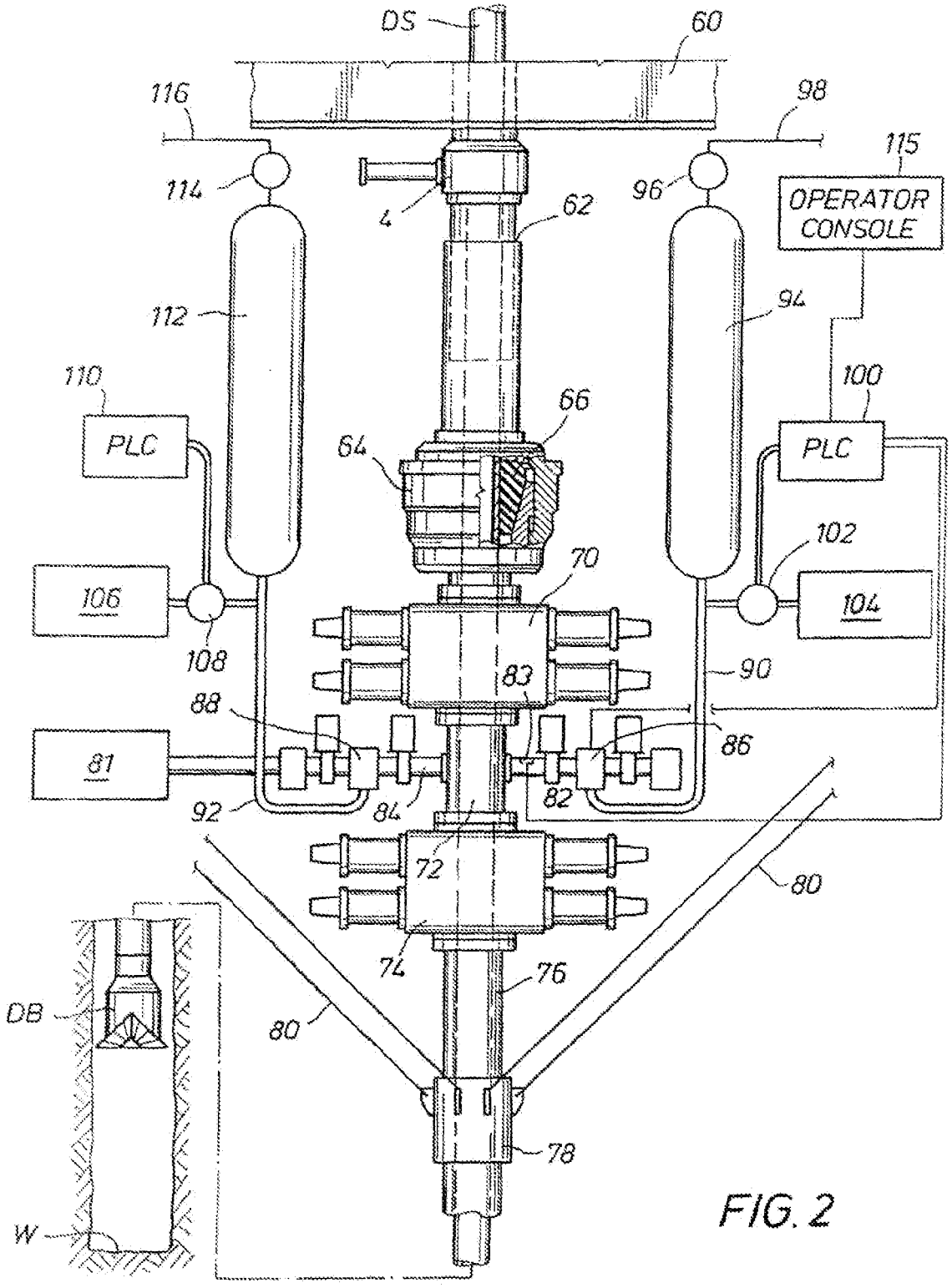
FIG. 2 is an elevational view of a riser with a telescoping joint, an annular BOP in cut away section showing the annular BOP seal sealing on a tubular, two ram-type BOPs, and a drill string or other tubular in the riser with the drill bit spaced apart from the wellbore, and on the right side of the riser a first T-connector with a first valve attached with a first flexible flow line in fluid communication with a first accumulator and a first gas supply source through a first pressure regulator, and on the left side of the riser a second T-connector with a second valve attached with a second flexible flow line in fluid communication with a second accumulator and a second gas supply source through a second pressure regulator, and a well control choke in fluid communication with the second T-connector.

For redundancy, it is contemplated that a mirror-image second accumulator, second gas source, and second pressure regulator may be fluidly connected with second flow line 32 similar to what is shown on the right side of the riser 16 in FIG. 1 and on the left side of the riser in FIG. 2. Alternatively, one accumulator, such as accumulator 34, may be fluidly connected with both flow lines (30, 32). It is also contemplated that a redundant system similar to any embodiment shown in any of the Figures or described therewith may be positioned on the left side of the embodiment shown in FIG. 1. It is contemplated that accumulator 34, gas source 42, and/or pressure regulator 40 may be positioned on or over the rig floor, above beam 2. It is contemplated that flow lines (30, 32) may have a diameter of 6 inches (15.2 cm), but other sizes are contemplated. Although flow lines (30, 32) are preferably flexible lines, partial rigid lines are also contemplated with flexible portions. First valve 26 and second valve 28 may be hydraulically remotely actuated controlled or operated gate (HCR) valves, although other types of valves are contemplated.

For FIG. 1, and for all embodiments shown in all the Figures, there may be additional flexible fluid lines fluidly connected with the T-connectors, such as the first and second T-connectors (23, 24) in FIG. 1. The additional fluid lines are not shown in any of the Figures for clarity. For example, there may be two additional fluid lines, one of which is redundant, for drilling fluid returns. There may also be an additional fluid line to a trip tank. There may also be an additional fluid line for over-pressure relief. Other additional fluid lines are contemplated. It is contemplated that each of the additional fluid lines may be fluidly connected to T-connectors with valves, such as HCR valves.

In FIG. 2, a plurality of riser tensioner cables 80 are attached at one end with a beam 60 of a floating rig, and at the other end with a riser tensioner ring 78. Riser tensioner ring 78 is positioned with riser 76. Riser tensioner ring 78 and riser tensioner cables 80 may be used with all embodiments shown in all of the Figures. Marine diverter 4 is positioned above telescoping joint 62 and below the rig beam 60. The non-movable end of telescoping joint 62 is disposed above the annular BOP 64. Annular BOP seal 66 is sealed on drill string or tubular DS. Unlike FIG. 1, there is no RCD in FIG. 2, since FIG. 2 shows a configuration for conventional drilling operations. Although a conventional drilling operation configuration is only shown in FIG. 2, a similar conventional drilling configuration may be used with all embodiments shown in all of the Figures. BOP spool 72 is positioned between upper ram-type BOP 70 and lower ram-type BOP 74. Other configurations and numbers of ram-type BOPs are contemplated. Drill string or tubular DS is shown with the drill bit DB spaced apart from the wellbore W, such as when tubular connections are made.

First T-connector 82 extends from the right side of the BOP spool 72, and first valve 86 is disposed with the first T-connector 82 and fluidly connected with first flexible flow line or hose 90. Although flexible flow lines are preferred, it is contemplated that partial rigid flow lines may also be used with flexible portions. First valve 86 may be remotely actuatable, and it may be in hardwire connection with a PLC 100. An operator console 115 may be in hardwire connection with PLC 100. The operator console 115 may be located on the rig for use by rig personnel. A similar operator console may be in hardwire connection with any PLC shown in any of the Figures. Sensor 83 may be positioned within first T-connector 82, as shown in FIG. 2, or with first valve 86. As shown, sensor 83 may be in hardwire connection with PLC 100. Sensor 83 may measure pressure, although other measurements are also contemplated, such as temperature or flow. Sensor 83, upon sensing a predetermined pressure or pressure range, may transmit a signal to PLC 100 through the hardwire connection or wirelessly to remotely actuate valve 86 to move the valve to the open position and/or the closed position. Additional sensors are contemplated, such as a sensor positioned with second T-connector 84 or second valve 88. First flow line 90 may be longer than the flow line or hose to the choke manifold, although other lengths are contemplated. A first gas accumulator 94 may be in fluid communication with first flow line 90. A first vent valve 96 may be disposed with first accumulator 94 to allow the movement of vent gas or other fluid through first vent line 98. A first gas source 104 may be in fluid communication with first flow line 90 through a first pressure regulator 102. First gas source 104 may provide a compressible gas, such as nitrogen or air. It is also contemplated that the first gas source 104 and/or pressure regulator 102 may be in fluid communication directly with first accumulator 94. First pressure regulator 102 may be in hardwire connection with PLC 100. However, the first pressure regulator 102 may be operated manually, semi-automatically, or automatically to maintain a predetermined pressure.

Second T-connector 84 extends from the left side of the BOP spool 72, and a second valve 88 is fluidly connected with the second T-connector 84 and fluidly connected with second flexible flow line or hose 92. For redundancy, a mirror-image second flow line 92 is fluidly connected with a second accumulator 112, a second gas source 106, a second pressure regulator 108, and a second PLC 110 similar to what is shown on the right side of the riser 76. Second vent valve 114 and second vent line 116 are in fluid communication with second accumulator 112. Alternatively, one accumulator may be fluidly connected with both flow lines (90, 92). A well control choke 81, such as used to circulate out a well kick, may also be in fluid connection with second T-connector 84. It is contemplated that other devices may be connected with first or second T-connectors (82, 84). First valve 86 and second valve 88 may be hydraulically remotely actuated controlled or operated gate (HCR) valves, although other types of valves are contemplated.

It is contemplated that riser 76 may be a casing type riser or slim riser with a pressure rating of 5000 psi or higher, although other types of risers are contemplated. The pressure rating of the system may correspond to that of the riser 76, although the pressure rating of the first flow line 90 and second flow line 92 must also be considered if they are lower than that of the riser 76. The use of surface BOPs and slim risers, such as 16 inch (40.6 cm) casing, allows older rigs to drill in deeper water than originally designed because the overall weight to buoy is less, and the rig has deck space for deeper water depths with a slim riser system than it would have available if it were carrying a typical 21¼ inch (54 cm) diameter riser with a 500 psi pressure rating. It is contemplated that first accumulator 94, second accumulator 112, first gas source 104, second gas source 106, first pressure regulator 102, and/or second pressure regulator 108 may be positioned on or over the rig floor, such as over beam 60.

Accumulator Method

When drilling using the embodiment shown in FIG. 1, such as for the CBHP variation of MPD, the first valve 26 is closed. The gas accumulator 34 contains a compressible gas, such as nitrogen or air, at a predetermined pressure, such as the desired BHP. Other gases and pressures are contemplated. The first valve 26 may have previously been opened and then closed to allow a predetermined amount of drilling fluid, such as the amount a heaving drill string may be anticipated to displace, to enter first flow line 30. The amount of liquid allowed to enter the line 30 may be 2 barrels or less. However, other amounts are contemplated. The liquid allowed to enter the first flow line 30 will create a liquid and gas interface, preferably in the first flow line 30 in the vertical section to the right of the flow line's catenary, such as at interface position 5 in first flow line 30. Other methods of creating the interface position 5 are contemplated.

When a connection to the drill string DS needs to be made, or when tripping, the rig's mud pumps are turned off and the first valve 26 may be opened. The rotation of the drill string DS is stopped and the drill string DS is lifted off bottom and suspended from the rig, such as with slips. Drill string or tubular DS is shown lifted in FIG. 1 so the drill bit DB is spaced apart from the wellbore W or off bottom, such as when tubular connections are made. If the floating rig has a prior art drill sting heave compensator device, it is no longer operating since the drill bit DB is lifted off bottom. It is otherwise turned off. As the rig heaves while the drill string connection is being made, the telescoping joint 6 will telescope, and the inserted drill string tubular will move in harmony with the rig. When the tubular moves downward, the volume of drilling fluid displaced by the downward movement will flow through first valve 26 into first flow line 30, moving the liquid and gas interface toward the gas accumulator 34. However, the interface may move into the accumulator 34. In either scenario, the liquid volume displaced by the movement of the drill string DS may be accommodated.

When the tubular moves upward, the pressure of the gas, and the suction or swab created by the tubular in the riser 16, will cause the liquid and gas interface to move along the first flow line 30 toward the riser 16, replacing the volume of drilling fluid moved by the tubular. A substantially equal amount of volume to that previously removed from the annulus is moved back into the annulus. The compressibility of the gas may significantly dampen the pressure fluctuations during connections. For a 6⅝ inch (16.8 cm) casing and 30 feet (9.1 m) of heave, it is contemplated that approximately 150 cubic feet of gas volume may be needed in the accumulator 34 and first flow line 30, although other amounts are contemplated The pressure regulator 40 may be used in conjunction with the gas source 42 to insure that a predetermined pressure of gas is maintained in the first flow line 30 and/or the gas accumulator 34. The pressure regulator 40 may be monitored or operated with a PLC 38. However, the pressure regulator 40 may be operated manually, semi-automatically, or automatically. A valve that may regulate pressure may be used instead of a pressure regulator. If the pressure regulator 40 or valve is PLC controlled, it may be controlled by an automated choke manifold system, and may be set to be the same as the targeted choke manifold's surface back pressure to be held when the rig's mud pumps are turned off. It is contemplated that the choke manifold back pressure and matching accumulator gas pressure setting are different values for each bit-off-bottom occasion, and determined by the circulating annular friction pressure while the last stand was drilled. It is contemplated that the values may be adjusted or constant.

Although the accumulator vent valve 36 usually remains closed, it may be opened to relieve undesirable pressure sensed in the accumulator 34. When the drill string connection is completed, first valve 26 is remotely actuated to a closed position and drilling or rotation of the tubular may resume. If a redundant system is connected with second flow line 32 as described above, it may be used instead of the system connected with first flow line 30, such as by keeping first valve 26 closed and opening second valve 28 when drill string connections need to be made. It is contemplated that second valve 28 may remain open for drilling. A redundant system may also be used in combination with the first flow line 30 system as discussed above.

When drilling using the embodiment shown in FIG. 2, for conventional drilling, the annular BOP seal 66 is open during drilling (unlike shown in FIG. 2), and the first valve 86 and second valve 88 are closed. To circulate out a kick, the annular BOP seal 66 may be sealed on the drill string or tubular DS as shown in FIG. 2. The seals in the ram-type BOPs (70, 74) remain open. The rig's mud pumps are turned off. If the floating rig has a prior art drill sting heave compensator device, it is no longer operating since the drill bit is lifted off bottom. It is otherwise turned off. If heave induced pressure fluctuations are anticipated while the seal 66 is sealed, the first valve 86 may be opened. The operation of the system is the same as described above for FIG. 1. If a redundant system is attached to second flow line 92 as shown in FIG. 2, then it may be operated instead of the system attached to the first flow line 90 by keeping first valve 86 closed and opening second valve 88 when annular BOP seal 66 is closed on the drill string DS. Alternatively, a redundant system may be used in combination with the system attached with first flow line 30.

For all embodiments shown in all of the Figures and/or discussed therewith, it is contemplated that the systems and methods may be used when tripping the drill string out of and returning it to the wellbore. During tripping, the drill bit DB is lifted off bottom, and the same methods may be used as described for when the drill bit DB is lifted off bottom for a drill string connection. The systems and methods offer the advantage of allowing for the optimization and/or maximization of tripping speeds by, in effect, cancelling the heave-up and heave down pressure fluctuations otherwise caused by a heaving drill string or other tubular. It is contemplated that the drill string or other tubular may be moved relative to the riser at a predetermined speed, and that any of the embodiments shown in any of the Figures may be positioned with the riser and operated to substantially eliminate the heave induced pressure fluctuations in the "pressure vessel" so that a substantially constant pressure may be maintained in the annulus between the tubular and the riser while the predetermined speed of the tubular is substantially maintained. Otherwise, a lower or variable tripping speed may need to be used.

For all embodiments shown in all of the Figures and/or discussed therewith, it is contemplated that pressure sensors (25, 83, 139, 211, 259) and a respective PLC (38, 100, 155, 219, 248) may be used to monitor pressures, heave-induced fluctuations of those pressures, and their rates of change, among other measurements. Actual heave may also be monitored, such as via riser tensioners, such as the riser tensioners (20, 22) shown in FIGS. 1 and 6, the movement of slip joints, such as the slip joint (6, 62, 124, 204, 280, 302) and/or with GPS. It is contemplated that actual heave may be correlated to measured pressures. For example, in FIG. 1 sensor 25 may measure pressure within first T-connector 23, and the information may be transmitted by a signal to and monitored and processed by a PLC. Additional sensors may be positioned with riser tensioners and/or telescoping slip joints to measure movement related to actual heave. Again, the information may be transmitted by a signal to and monitored and processed by a PLC. The information may be used to remotely open and close first valve 26, such as in FIG. 1 through a signal transmitted from PLC 38 to first valve 26. In addition, all of the information may be used to build and/or update a dynamic computer software model of the system, which model may be used to control the heave compensation system and/or to initiate predictive control, such as by controlling when valves, such a first valve 26 in FIG. 1, pressure regulators and pumps, such as mud pump 156 with pressure regulator shown in FIG. 3, or other devices are activated or deactivated. The sensing of the drill bit DB off bottom may cause a PLC (38, 100, 155, 219, 248) to open the HCR valve, such as first valve 26 in FIG. 1. The drill string may then be held by spider slips. An integrated safety interlock system available from Weatherford International, Inc. of Houston, Tex. may be used to prevent inadvertent opening or closing of the spider slips.

Pump and Relieve System

Figure 3:
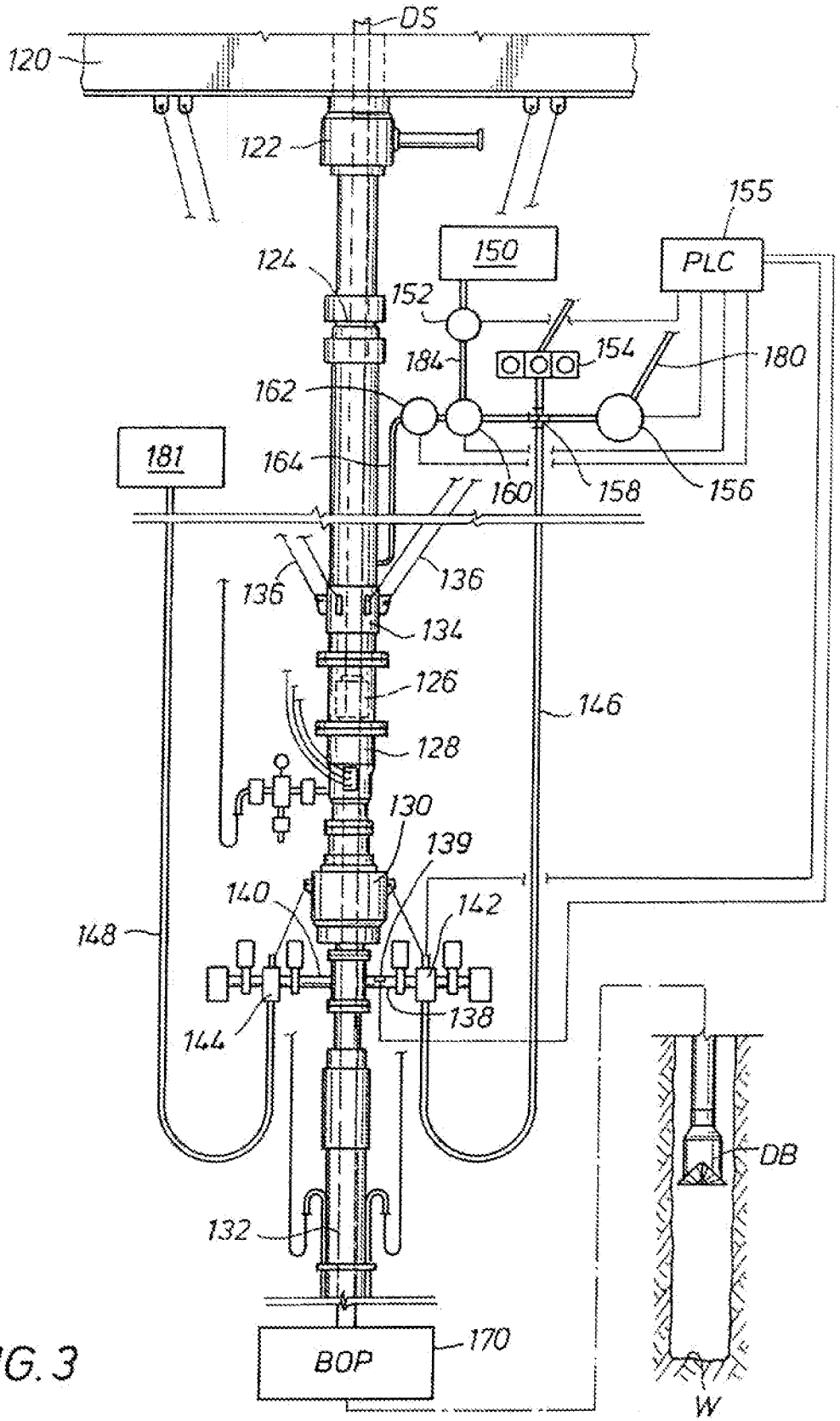
FIG. 3 is an elevational view of a riser with a telescoping joint, an RCD housing with a RCD shown in phantom, an annular BOP, and a drill string or other tubular in the riser with the drill bit spaced apart from the wellbore, and on the right side of the riser a first T-connector with a first valve attached with a first flexible flow line in fluid communication with a mud pump with a pressure regulator, a pressure compensation device, and a first trip tank through a pressure relief valve, and on the left side of the riser a second T-connector with a second valve attached with a second flexible flow line in fluid communication with a second trip tank.
Figure 4:
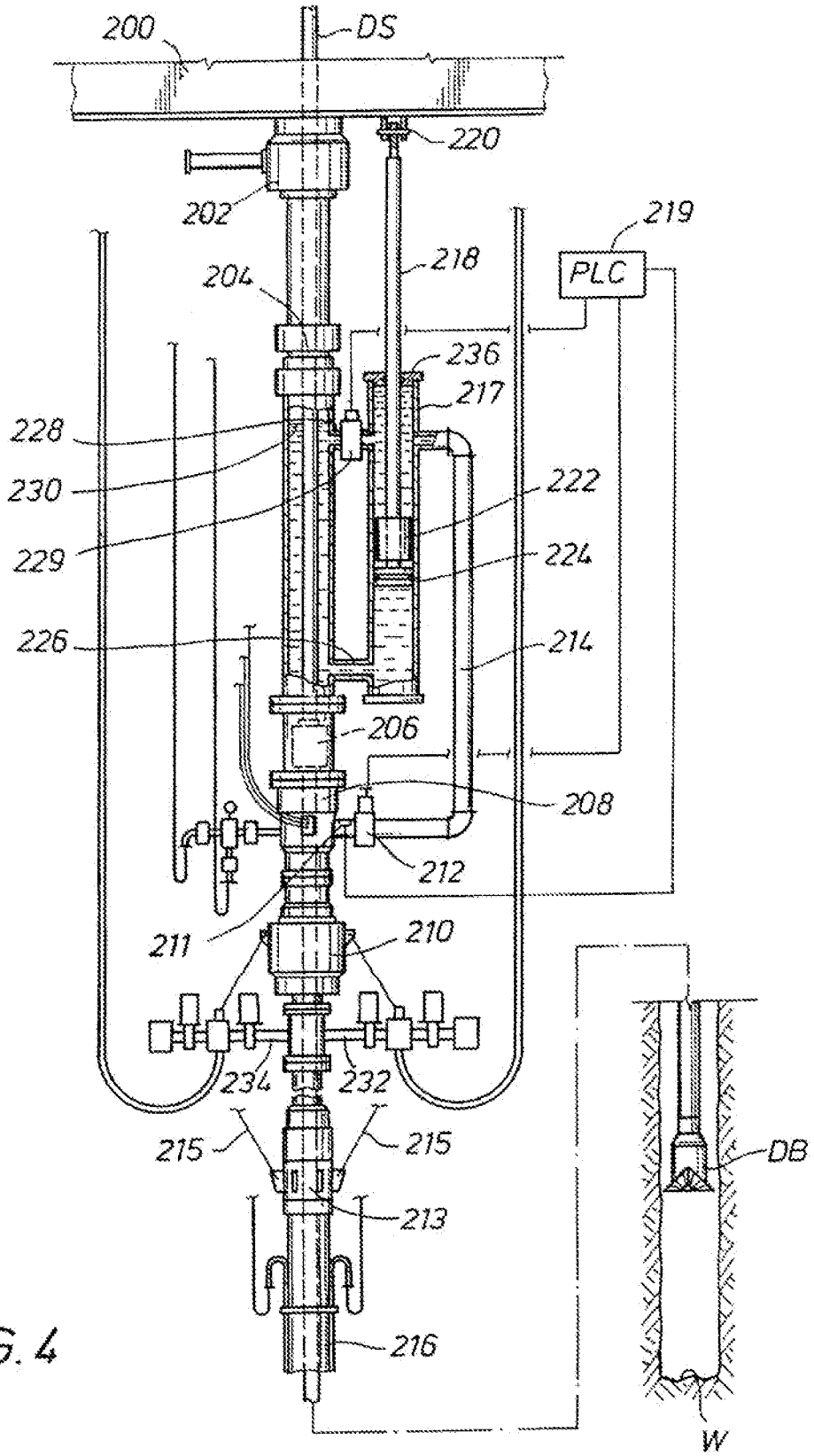
FIG. 4 is an elevational view of a riser with a telescoping joint, an RCD housing with a RCD shown in phantom, an annular BOP, and a drill string or other tubular in the riser with the drill bit spaced apart from the wellbore, and on the right side of the riser a first valve and a flow line in fluid communication with a fluid container shown in cut away section having a fluid container piston, a first conduit shown in cut away section in fluid communication between the fluid container and the riser, and a second conduit in fluid communication between the fluid container and the riser through a second valve.

Turning to FIG. 3, riser tensioner cables 136 are attached at one end with beam 120 of a floating rig, and at the other end with riser tensioner ring 134. Beam 120 may be a rotary table beam, but other structural support members on the rig are contemplated. Riser tensioner ring 134 is positioned with riser 132 below telescoping joint 124 but above the RCD 126 and T-connectors (138, 140). Tensioner ring 134 may be disposed with riser 132 in other locations, such as shown in FIG. 4. Returning to FIG. 3, diverter 122 is attached above telescoping joint 124 and below the rig beam 120. RCD 126 is disposed in RCD housing 128 over annular BOP 130. Annular BOP 130 is optional.

RCD housing 128 may be a housing such as the docking station housing in Pub. No. US 2008/0210471 positioned above the surface of the water for latching with an RCD. However, other RCD housings are contemplated, such as the RCD housings disposed in a marine riser proposed in U.S. Pat. Nos. 6,470,975; 7,159,669; and 7,258,171. The RCD 126 may allow for MPD, including the CBHP variation of MPD. A subsea BOP 170 is positioned on the wellhead at the sea floor. The subsea BOP 170 may be a ram-type BOP and/or an annular BOP. Although the subsea BOP 170 is only shown in FIG. 3, it may be used with all embodiments shown in all of the Figures. Drill string or tubular DS is disposed in riser 132 and shown lifted so the drill bit DB is spaced apart from the wellbore W, such as when tubular connections are made.

First T-connector 138 extends from the right side of the riser 132, and first valve 142 is fluidly connected with the first T-connector 138 and fluidly connected with first flexible flow line 146. First valve 142 may be remotely actuatable. First valve 142 may be in hardwire connection with a PLC 155. Sensor 139 may be positioned within first T-connector 138, as shown in FIG. 3, or with first valve 142. Sensor 139 may be in hardwire connection with PLC 155. Sensor 139 may measure pressure, although other measurements are also contemplated, such as temperature or flow. Sensor 139 may signal PLC 155 through the hardwire connection or wirelessly to remotely actuate valve 142 to move the valve to the open position and/or the closed position. Additional sensors are contemplated, such as positioned with second T-connector 140 or second valve 144. First fluid line 146 may be in fluid communication through a four-way mud cross 158 with a mud pump 156 with a pressure regulator, a pressure compensation device 154, and a first trip tank or fluid container 150 through a pressure relief valve 160. Other configurations are contemplated. It is also contemplated that a pressure regulator that is independent of mud pump 156 may be used. First trip tank 150 may be a dedicated trip tank, or an existing trip tank on the rig used for multiple purposes. The pressure regulator may be set at a first predetermined pressure for activation of mud pump 156.

Pressure compensation device 154 may be adjustable chokes that may be set at a second predetermined pressure to allow fluid to pass. Pressure relief valve 160 may be in hardwire connection with PLC 155. However, it may also be operated manually, semi-automatically, or automatically. Mud pump 156 may be in fluid communication with a fluid source through mud pump line 180. Tank valve 152 may be fluidly connected with tank line 184, and riser valve 162 may be fluidly connected with riser line 164. As will become apparent with the discussion of the method below, riser line 164 and tank line 184 provide a redundancy, and only one line (164, 184) may preferably be used at a time. First valve 142 may be an HCR valve, although other types of valves are contemplated. Mud pump 156, tank valve 152, and/or riser valve 162 may each be in hardwire connection with PLC 155.

Second T-connector 140 extends from the left side of the riser 132, and second valve 144 is fluidly connected with the second T-connector 140 and fluidly connected with second flexible flow line 148, which is fluidly connected with a second trip tank 181, such as a dedicated trip tank, or an existing trip tank on the rig used for multiple purposes. It is also contemplated that there may be only first trip tank 150, and that second flow line 148 may be connected with first trip tank 150. It is also contemplated that instead of second trip tank 181, there may be a MPD drilling choke connected with second flow line 148. The MPD drilling choke may be a dedicated choke manifold that is manual, semi-automatic, or automatic. Such an MPD drilling choke is available from Secure Drilling International, L.P. of Houston, Tex., now owned by Weatherford International, Inc.

Second valve 144 may be remotely actuatable. It is also contemplated that second valve 144 may be a settable overpressure relief valve, or that it may be a rupture disk device that ruptures at a predetermined pressure to allow fluid to pass, such as a predetermined pressure less than the maximum allowable pressure capability of the riser 132. It is also contemplated that for redundancy, a mirror-image configuration identical to that shown on the right side of the riser 132 may also be used on the left side of the riser 132, such as second fluid line 148 being in fluid communication through a second four-way mud cross with a second mud pump, a second pressure compensation device, and a second trip tank through a second pressure relief valve. It is contemplated that mud pump 156, pressure compensation device 154, pressure relief valve 160, first trip tank 150, and/or second trip tank 180 may be positioned on or over the rig floor, such as over beam 120.

Pump and Relieve Method

When drilling using the embodiment shown in FIG. 3, such as for the CBHP variation of MPD, the first valve 142 is closed. When a connection to the drill string or tubular DS needs to be made, the rig's mud pumps are turned off and the first valve 142 is opened. If a redundant system (not shown in FIG. 3) on the left of the riser 132 is going to be used, then the second valve 144 is opened and the first valve 142 is kept closed. The rotation of the drill string DS is stopped and the drill string is lifted off bottom and suspended from the rig, such as with slips. Drill string or tubular DS is shown lifted in FIG. 3 with the drill bit DB spaced apart from the wellbore W or off bottom, such as when tubular connections are made. As the rig heaves while the drill string connection is being made, the telescoping joint 124 will telescope, and the inserted drill string or tubular DS will move in harmony with the rig. If the floating rig has a prior art drill sting heave compensator device, it is no longer operating since the drill bit is lifted off bottom. It is otherwise turned off.

Using the system shown to the right of the riser 132, when the drill string or tubular moves downward, the volume of drilling fluid displaced by the downward movement will flow through the open first valve 142 into first flow line 146, which contains the same type of drilling fluid or water as is in the riser 132. First pressure relief valve 160 may be pre-set to open at a predetermined pressure, such as the same setting as the drill choke manifold during that connection, although other settings are contemplated. At the predetermined pressure, first pressure relief valve 160 allows a volume of fluid to move through it until the pressure of the fluid is less than the predetermined pressure. The downward movement of the tubular will urge the fluid in first flow line 146 past the first pressure relief valve 160.

If tank line 184 and riser line 164 are both present as shown in FIG. 3, then either tank valve 152 will be open and riser valve 162 will be closed, or riser valve 162 will be open and tank valve 152 will be closed. If tank valve 152 is open, the fluid from line 146 will flow into first trip tank 150. If riser valve 162 is open, then the fluid from line 146 will flow into riser 132 above sealed RCD 126. As can now be understood, riser line 164 and tank line 184 are alternative and redundant lines, and only one line (164, 184) is preferably used at a time, although it is contemplated that both lines (164, 184) may be used simultaneously. As can also now be understood, first trip tank 150 and the riser 132 above sealed RCD 126 both act as fluid containers.

When the drill string or tubular DS moves upward, the mud pump 156 with pressure regulator is activated and moves fluid through the first fluid line 146 and into the riser 132 below the sealed RCD 126. The pressure regulator with the mud pump 156 and/or the pressure compensation device 154 may be pre-set at whatever pressure the shut-in manifold surface backpressure target should be during the tubular connection, although other settings are contemplated. It is contemplated that mud pump 156 may alternatively be in communication with the flow line serving the choke manifold rather than a dedicated flow line such as first flow line 146. It is also contemplated that mud pump 156 may alternatively be the rig's mud kill pump, or a dedicated auxiliary mud pump such as shown in FIG. 3.

It is also contemplated that mud pump 156 may be an auxiliary mud pump such as proposed in the auxiliary pumping systems shown in FIG. 1 of U.S. Pat. No. 6,352,129, FIGS. 2 and 2a of U.S. Pat. No. 6,904,981, and FIG. 5 of U.S.

Pat. No. 7,044,237, all of which patents are hereby incorporated by reference for all purposes in their entirety. It is contemplated that mud pump 156 may be used in combination with the auxiliary pumping systems proposed in the '129, '981, and '237 patents. Mud pump 156 may receive fluid through mud pump line 180 from a fluid source, such as first trip tank 150, the rig's drilling fluid source, or a dedicated mud source. When the drill string connection is completed, first valve 142 is closed and rotation of the tubular or drilling may resume.

It should be understood that when drilling conventionally, the embodiment shown in FIG. 3 may be positioned with a riser configuration such as shown in FIG. 2. The annular BOP seal 66 may be sealed on the drill string or tubular DS to circulate out a kick. If heave induced pressure fluctuations are anticipated while the seal 66 is sealed, the first valve 142 of FIG. 3 may be opened. The operation of the system is the same as described above for FIG. 3. If a redundant system is fluidly connected to second flow line 148 (not shown in FIG. 3), then it may be operated instead of the system attached to the first flow line 146 by keeping first valve 142 closed and opening second valve 144.

Slip Joint Piston System

Turning to FIG. 4, riser tensioner cables 215 are attached at one end with beam 200 of a floating rig, and at the other end with riser tensioner ring 213. Beam 200 may be a rotary table beam, but other structural support members on the rig are contemplated. Riser tensioner ring 213 is positioned with riser 216. Tensioner ring 213 may be disposed with riser 216 in other locations, such as shown in FIG. 3. Returning to FIG. 4, marine diverter 202 is disposed above telescoping joint 204 and below rig beam 200. RCD 206 is disposed in RCD housing 208 above annular BOP 210. Annular BOP 210 is optional. There may also be a surface ram-type BOP, as well as a subsea annular BOP and/or a subsea ram-type BOP.

RCD housing 208 may be a housing such as the docking station housing proposed in Pub. No. US 2008/0210471. However, other RCD housings are contemplated, such as the RCD housings disposed in a marine riser proposed in U.S. Pat. Nos. 6,470,975; 7,159,669; and 7,258,171. The RCD 206 allows for MPD, including the CBHP variation of MPD. First T-connector 232 and second T-connector 234 with fluidly connected valves and flow lines are shown extending outwardly from the riser 216. However, they are optional for this embodiment. Drill string DS is disposed in riser 216 with drill bit DB spaced apart from the wellbore W, such as when tubular connections are made.

Flow line 214 with first valve 212 may be fluidly connected with RCD housing 208. It is also contemplated that flow line 214 with first valve 212 may alternatively be fluidly connected below the RCD housing 208 with riser 216 or it components. Flow line 214 may be flexible, rigid, or a combination of flexible and rigid. First valve 212 may be remotely actuatable and in hardwire connection with a PLC 219. Sensor 211 may be positioned within flow line 214, as shown in FIG. 4, or with first valve 212. Sensor 211 may be in hardwire connection with PLC 219. Sensor 211, upon sensing a predetermined pressure or pressure range, may transmit a signal to PLC 219 through the hardwire connection or wirelessly to remotely actuate valve 212 to move the valve to the open position and/or closed position. Sensor 211 may measure pressure, although other measurements are also contemplated, such as temperature or flow. Additional sensors are contemplated. A fluid container 217 that is slidably sealed with a fluid container piston 224 may be in fluid communication with flow line 214. One end of piston rod 218 may be attached with rig beam 200. It is contemplated that piston rod 218 may alternatively be attached with the floating rig at other locations, or with the movable or inner barrel of the telescoping joint 204, that is in turn attached to the floating rig. It is contemplated that piston rod 218 may have an outside diameter of 3 inches (7.6 cm), although other sizes are contemplated.

It is contemplated that fluid container 217 may have an outside diameter of 10 inches (25.4 cm), although other sizes are contemplated. It is contemplated that the pressure rating of the fluid container 217 may be a multiple of the maximum surface back pressure during connections, such as 3000 psi, although other pressure ratings are contemplated. It is contemplated that the volume capacity of the fluid container 217 may be approximately twice the displaced annulus volume resulting from the drill string or tubular DS at maximum wave heave, such as for example 2.6 barrels (1.3 barrels×2) assuming a 6⅝ inch (16.8 cm) diameter drill string and 30 foot (9.1 m) heave (peak to valley and back to peak). The height of the fluid container 217 and the length of the piston rod 218 in the fluid container 217 should be greater than the maximum heave distance to insure that the piston 224 remains in the fluid container 217. The height of the fluid container 217 may be about the same height as the outer barrel of the slip joint 204. The piston rod may be in 10 foot (3 m) threaded sections to accommodate a range of wave heaves. The fluid container and piston could be fabricated by The Sheffer Corporation of Cincinnati, Ohio.

A shearing device such as shear pin 220 may be disposed with piston rod 218 at its connection with rig beam 200 to allow a predetermined location and force shearing of the piston rod 218 from the rig. Other shearing methods and systems are contemplated. Piston rod 218 may extend through a sealed opening in fluid container cap 236. A volume adjustment member 222 may be positioned with piston 224 to compensate for different annulus areas including sizes of tubulars inserted through the riser 216, or different riser sizes, and therefore the different volumes of fluid displaced. Volume adjustment member 222 may be clamped or otherwise positioned with piston rod 218 above piston 224. Drill string or tubular DS is shown lifted with the drill bit spaced apart from the wellbore, such as when tubular connections are made.

As an alternative to using a different volume adjustment member 222 for different tubular sizes, it is contemplated that piston rods with different diameters may be used to compensate for different annulus areas including sizes of tubulars inserted through the riser 216 and risers. As another alternative, it is contemplated that different fluid containers 217 with different volumes, such as having the same height but different diameters, may be used to compensate for different diameter tubulars. A smaller tubular diameter may correspond with a smaller fluid container diameter.

First conduit 226, such as an open flanged spool, provides fluid communication between the fluid container 217 and the riser 216 above the sealed RCD 206. Second conduit 228 provides fluid communication between the fluid container 217 and the riser 216 above the sealed RCD 206 through second valve 229. Second valve 229 may be remotely actuatable and in hardwire connection with PLC 219. Fluid, such as drilling fluid, seawater, or water, may be in fluid container 217 above and below piston 224. The fluid may be in riser 216 at a fluid level, such as fluid level 230, to insure that there is fluid in fluid container 217 regardless of the position of piston 224. First conduit 226 and second conduit 228 may be 10 inches (25.4 cm) in diameter, although other diameters are also contemplated. First valve 212 and/or second valve 229 may be HCR valves, although other types of valves are contemplated. Although not shown, it is contemplated that a redundant system may be attached to the left side of riser 216 similar to the system shown on the right side of the riser 216 or similar to any embodiment shown in any of the Figures. It is also contemplated that as an alternative embodiment to FIG. 4, the fluid container 217 may be positioned on or over the rig floor, such as over rig beam 200. The piston rod 218 would extend upward from the rig, rather than downward as shown in FIG. 4, and flow line 214 and first and second conduits (226, 228) would need to be longer and preferably flexible.

Figure 5:
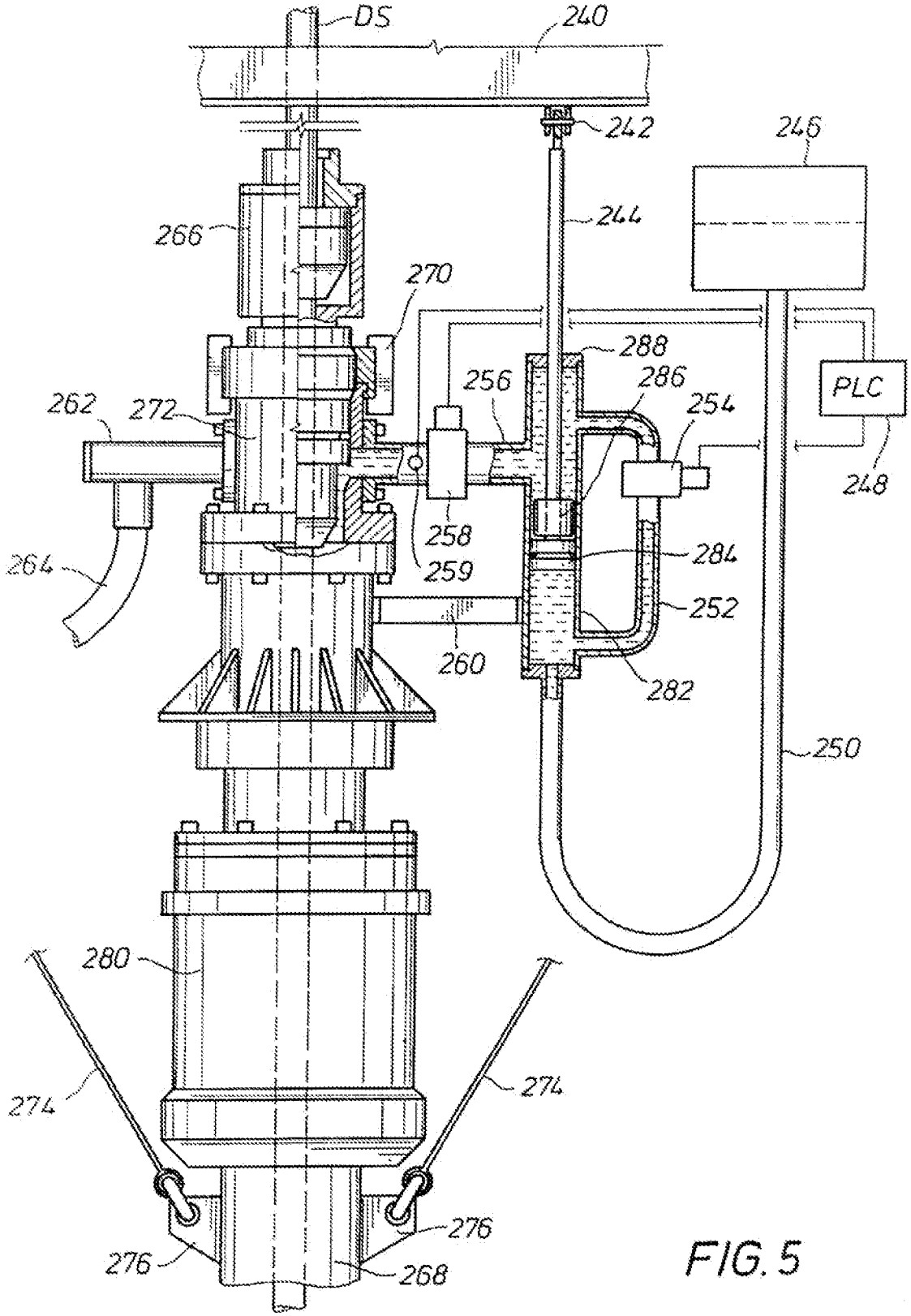
FIG. 5 is an elevational view of a riser, an RCD in partial cut away section disposed with an RCD housing, and on the right side of the riser a first valve and a flow line in fluid communication with a fluid container shown in cut away section having a fluid container piston and a fluid container conduit with a second valve, and a trip tank conduit in fluid communication with a trip tank.

Turning to FIG. 5, riser tensioner cables 274 are attached at one end with beam 240 of a floating rig, and at the other end with riser tensioner brackets 276. Riser tensioner brackets 276 are positioned with riser 268. Riser tensioner brackets 276 may be disposed with riser 268 in other locations. Riser tensioner brackets 276 may be disposed with a riser tensioner ring, such as tensioner ring 213 shown in FIG. 4. Returning to FIG. 5, RCD 266 is clamped with clamp 270 to RCD housing 272, which is disposed above a telescoping joint 280 and below rig beam 240. RCD housing 272 may be a housing such as proposed in FIG. 3 of U.S. Pat. No. 6,913,092. As discussed in the '092 patent, telescoping joint 280 can be locked or unlocked as desired when used with the RCD system in FIG. 5. However, other RCD housings are contemplated. The RCD 266 allows for MPD, including the CBHP variation of MPD. Drill string DS is disposed in riser 268. When unlocked, telescoping joint 280 may lengthen or shorten the riser 268 by extending or retracting, respectively.

Flow line 256 with first valve 258 may be fluidly connected with RCD housing 272. It is also contemplated that flow line 256 with first valve 258 may alternatively be fluidly connected below the RCD housing 272 with riser 268 or any of its components. Flow line 256 may be rigid, flexible, or a combination of flexible and rigid. First valve 258 may be remotely actuatable and in hardwire connection with a PLC 248. Sensor 259 may be positioned within flow line 256, as shown in FIG. 5, or with first valve 258. Sensor 259 may be in hardwire connection with PLC 248. Sensor 259, upon sensing a predetermined pressure or range of pressure, may transmit a signal to PLC 248 through the hardwire connection or wirelessly to remotely actuate valve 258 to move the valve to the open position and/or closed position. Sensor 259 may measure pressure, although other measurements are also contemplated, such as temperature or flow. Additional sensors are contemplated. A fluid container 282 that is slidably sealed with a fluid container piston 284 may be in fluid communication with flow line 256. One end of piston rod 244 may be attached with rig beam 240. It is contemplated that piston rod 244 may alternatively be attached with the floating rig at other locations, or with the movable or inner barrel of the telescoping joint 280, that is in turn attached to the floating rig. It is contemplated that piston rod 244 may have an outside diameter of 3 inches (7.6 cm), although other sizes are contemplated.

It is contemplated that fluid container 282 may have an outside diameter of 10 inches (25.4 cm), although other sizes are contemplated. It is contemplated that the pressure rating of the fluid container 282 may be a multiple of the maximum surface back pressure during connections, such as 3000 psi, although other pressure ratings are contemplated. It is contemplated that the volume capacity of the fluid container 282 may be approximately twice the displaced annulus volume resulting from the drill string or tubular at maximum wave heave, such as for example 2.6 barrels (1.3 barrels×2) assuming a 6⅝ inch (16.8 cm) diameter drill string and 30 foot (9.1 m) heave (peak to valley and back to peak). The height of the fluid container 282 and the length of the piston rod 244 in the fluid container 282 should be greater than the maximum heave distance to insure that the piston 284 remains in the fluid container 282. The height of the fluid container 282 may be about the same height as the outer barrel of the slip joint 280. The piston rod may be in 10 foot (3 m) threaded sections to accommodate a range of wave heaves. The fluid container and piston could be fabricated by The Sheffer Corporation of Cincinnati, Ohio.

A shearing device such as shear pin 242 may be disposed with piston rod 244 at its connection with rig beam 240 to allow a predetermined location and force shearing of the piston rod 244 from the rig. Other shearing methods and systems are contemplated. Piston rod 244 may extend through a sealed opening in fluid container cap 288. A volume adjustment member 286 may be positioned with piston 244 to compensate for different annulus areas including sizes of tubulars inserted through the riser 268, or different riser sizes, and therefore the different volumes of fluid displaced.

Volume adjustment member 286 may be clamped or otherwise positioned with piston rod 244 above piston 284. As an alternative to using a different volume adjustment member 286 for different tubular sizes, it is contemplated that piston rods with different diameters may be used to compensate for different annulus areas including sizes of tubulars inserted through the riser 268 and risers. As another alternative, it is contemplated that different fluid containers 282 with different volumes, such as having the same height but different diameters, may be used to compensate for different diameter tubulars. A smaller tubular diameter may correspond with a smaller fluid container diameter.

Fluid container conduit 252 is in fluid communication through second valve 254 between the portion of fluid container 282 above the piston 284 and the portion of fluid container 282 below piston 284. Second valve 254 may be remotely actuatable, and in hardwire connection with PLC 248. Any hardwire connections with a PLC in any of the embodiments in any of the Figures may also be wireless. Trip tank conduit 250 is in fluid communication between the fluid container 282 and trip tank 246. Trip tank 246 may be a dedicated trip tank, or it may be an existing trip tank on the rig that may be used for multiple purposes. Trip tank 246 may be located on or over the rig floor, such as over rig beam 240. Bracket support member 260, such as a blank flanged spool, may support fluid container 282 from riser 268. Other types of attachment are contemplated. Fluid, such as drilling fluid, seawater, or water, may be in fluid container 282 above and below piston 284. The fluid may be in riser 268 at a sufficient fluid level to insure that there is fluid in fluid container 282 regardless of the position of piston 284. The fluid may also be in the trip tank 246 at a sufficient level to insure that there is fluid in fluid container 282 regardless of the position of piston 284.

Flow line 256 may be 10 inches (25.4 cm) in diameter, although other diameters are also contemplated. First valve 258 and/or second valve 254 may be HCR valves, although other types of valves are contemplated. Although not shown, it is contemplated that a redundant system may be attached to the left side of riser 268 similar to the system shown on the right side of the riser 216 or similar to any embodiment shown in any of the Figures. On the left side of riser 268, flow hose 264 is fluidly connected with RCD housing 272 through T-connector 262. Flow hose 264 may be in fluid communication with the rig's choke manifold, or other devices. It is also contemplated that as an alternative embodiment to FIG. 5, the fluid container 282 may be positioned on or over the rig floor, such as over rig beam 240. The piston rod 244 would extend upward from the rig, rather than downward as shown in FIG. 5, and flow line 256 would need to be longer and preferably flexible.

As another alternative to FIG. 5, an alternative embodiment system may be identical with the fluid container 282, piston 284 and trip tank 246 system shown on the right side of riser 268 in FIG. 5, except that rather than there being a flow line 256 with first valve 258 in fluid communication between the RCD housing 272 and the fluid container 282 as shown in FIG. 5, there may be a flexible flow line with first valve in fluid communication between the fluid container and the riser below the RCD or annular BOP, such as with one end of the flow line connected to a BOP spool between two ram-type surface BOPs and the other end connected with the side of the fluid container near its top. The flow line may connect with the fluid container on the same side as the fluid container conduit, although other locations are contemplated. The alternative embodiment would work with any riser configuration shown in any of the Figures.

The alternative fluid container may be attached with some part of the riser or its components using one or more attachment support members, similar to bracket support member 260 in FIG. 5. It is also contemplated that riser tensioner members, such as riser tensioner members (20, 22) in FIG. 1, may be used instead of the tension cables 274 in FIG. 5. The alternative fluid container, similar to container 282 in FIG. 5 but with the difference described above, may alternatively be attached to the outer barrel of one of the tensioner members. As another alternative embodiment, the alternative fluid container with piston system could be used in conventional drilling such as with the riser and annular BOP shown in FIG. 2, either attached with the riser or its components or attached to a riser tensioner member that may be used instead of riser tension cables.

Slip Joint Piston Method

When drilling using the embodiment shown in FIG. 4, such as for the CBHP variation of MPD, the first valve 212 is closed and the second valve 229 is opened. When the rig heaves while the drill bit DB is on bottom and the drill string DS is rotating during drilling, the piston 224 moves fluid into and out of the riser 216 above the RCD 206 through first conduit 226 and second conduit 228. When a connection to the drill string or tubular needs to be made, the rig's mud pumps are turned off, first valve 212 is opened, and second valve 229 is closed. The drill string or tubular DS is lifted off bottom as shown in FIG. 4 and suspended from the rig, such as with slips.

As the rig heaves while the drill string or tubular connection is being made, the telescoping joint 204 will telescope, and the inserted drill string or tubular DS will move in harmony with the rig. If the floating rig has a prior art drill sting or heave compensator device, it is no longer operating since the drill bit is lifted off bottom. It is otherwise turned off. When the drill string or tubular DS moves downward, the piston 224 connected by piston rod 218 to rig beam 200 will move downward a corresponding distance. The volume of fluid displaced by the downward movement of the drill string or tubular will flow through the open first valve 212 through flow line 214 into fluid container 217. Piston 224 will move a corresponding amount of fluid from the portion of fluid container 217 below piston 224 through first conduit 226 into riser 216.

When the drill string or tubular moves upward, the piston 224, which is connected with the rig beam 200, will also move a corresponding distance upward. The piston 224 will displace fluid above it in fluid container 217 through fluid line 214 into riser 216 below RCD 206. The amount of fluid displaced by piston 224 desirably corresponds with the amount of fluid displaced by the tubular. Fluid will flow from the riser 216 above the RCD 206 or annular BOP through first conduit 226 into the fluid container 217 below the piston 224. A volume adjustment member 222 may be positioned with the piston 224 to compensate for a different diameter tubular.

It is contemplated that there may be a different volume adjustment member for each tubular size, such as for different diameter drill pipe and risers. A shearing member, such as shear pin 220, allows piston rod 218 to be sheared from rig beam 200 in extreme heave conditions, such as hurricane type conditions. When the drill string or tubular connection is completed, the first valve 212 may be closed, the second valve 229 opened, the drill string DS lowered so that the drill bit is on bottom, the mud pumps turned on, and rotation of the tubular begun so drilling may resume.

It should be understood that when drilling conventionally, the embodiment shown in FIG. 4 may be positioned with a riser configuration such as shown in FIG. 2. The annular BOP seal 66 is sealed on the drill string tubular DS to circulate out a kick. If heave induced pressure fluctuations are anticipated while the seal 66 is sealed, the first valve 212 of FIG. 4 may be opened and the second valve 229 closed. The operation of the system is the same as described above for FIG. 4. Other embodiments of FIG. 4 are contemplated, such as the downward movement of a piston moving fluid into the riser annulus below an RCD or annular BOP, and the upward movement of the piston moving fluid out of the riser annulus below an RCD or annular BOP. The piston moves in the same direction and the same distance as the tubular, and moves the required amount of fluid into or out of the riser annulus below the RCD or annular BOP.

When drilling using the embodiment shown in FIG. 5, such as for the CBHP variation of MPD with the telescoping joint 280 in the locked position, the first valve 258 is closed and the second valve 254 is opened. The heaving movement of the rig will cause the piston 284 to move fluid through the fluid container conduit 252 and between the fluid container 282 and the trip tank 246. When a connection to the drill string or tubular needs to be made, the rig's mud pumps are turned off, first valve 258 is opened, and second valve 254 is closed. The drill string or tubular DS is lifted off bottom and suspended from the rig, such as with slips. if the floating rig has a prior art drill sting or heave compensator device, it is no longer operating since the drill bit is lifted off bottom. It is otherwise turned off.

As the rig heaves while the drill string or tubular connection is being made, the telescoping joint 280 can telescope if in the unlocked position or remains fixed if in the locked position, and, in any case, the inserted drill string or tubular DS will move in harmony with the rig. When the drill string or tubular moves downward, the piston 284 connected by piston rod 244 to rig beam 240 will move downward a corresponding distance. The volume of fluid displaced by the downward movement of the drill string or tubular DS will flow through the open first valve 258 through flow line 256 into fluid container 282. Piston 284 will move a corresponding amount of fluid from the portion of fluid container 282 below piston 284 through trip tank conduit 250 into trip tank 246.

When the drill string or tubular moves upward, the piston 284, which is connected with the rig beam 240, will also move a corresponding distance upward. The piston 284 will displace fluid above it in fluid container 282 through flow line 256 into RCD housing 272 or riser 268 below RCD 266. The amount of fluid displaced by piston 284 desirably corresponds with the amount of fluid displaced by the tubular. Fluid will move from trip tank 246 through trip tank flexible conduit 250 into fluid container 282 below piston 284. A volume adjustment member 286 may be positioned with the piston 284 to compensate for a different diameter tubular. It is contemplated that there may be a different volume adjustment member for each tubular size, such as for different diameter drill pipe and risers.

A shearing member, such as shear pin 242, allows piston rod 244 to be sheared from rig beam 240 in extreme heave conditions, such as hurricane type conditions. When the drill string or tubular connection is completed, first valve 258 may be closed, second valve 254 opened, the drill string DS lowered so that the drill bit DB is on bottom, the mud pumps turned on, and rotation of the tubular begun so drilling may resume.

It should be understood that when drilling conventionally, the embodiment shown in FIG. 5 may be positioned with a riser configuration such as shown in FIG. 2. The annular BOP seal 66 is sealed on the drill string tubular to circulate out a kick. If heave induced pressure fluctuations are anticipated while the seal 66 is sealed, the first valve 258 of FIG. 5 may be opened and the second valve 254 may be closed. The operation of the system is the same as described above for FIG. 5. Other embodiments of FIG. 5 are contemplated, such as the downward movement of a piston moving fluid into the riser annulus below an RCD or annular BOP, and the upward movement of the piston moving fluid out of the riser annulus below an RCD or annular BOP. The piston moves in the same direction and the same distance as the tubular, and moves the required amount of fluid into or out of the riser annulus below the RCD or annular BOP.

For the alternative embodiment to FIG. 5 described above having a flow line with valve between the fluid container and the riser below the RCD or annular BOP, and fluid container mounted to the riser or its components or to the outer barrel of a riser tensioner member, such as riser tensioner members (20, 22) in FIG. 1, the first valve is closed during drilling, and the second valve is opened. The heaving movement of the rig will cause the piston to move fluid through the fluid container conduit and between the fluid container and the trip tank. When a connection to the drill string or tubular needs to be made, the rig's mud pumps are turned off, the first valve is opened, and second valve is closed. The drill string or tubular is lifted off bottom and suspended from the rig, such as with slips. The method is otherwise the same as described above for FIG. 5.

As will be discussed below in conjunction with FIG. 6, when the telescoping joint 280 of FIG. 5 is unlocked and allowed to extend and retract, the drill bit may be on bottom for drilling. Any of the embodiments shown in FIGS. 1-5 may be used to compensate for the change in annulus pressure that would otherwise occur below the RCD 266 due to the lengthening and shortening of the riser 268.

System while Drilling

Figure 6:
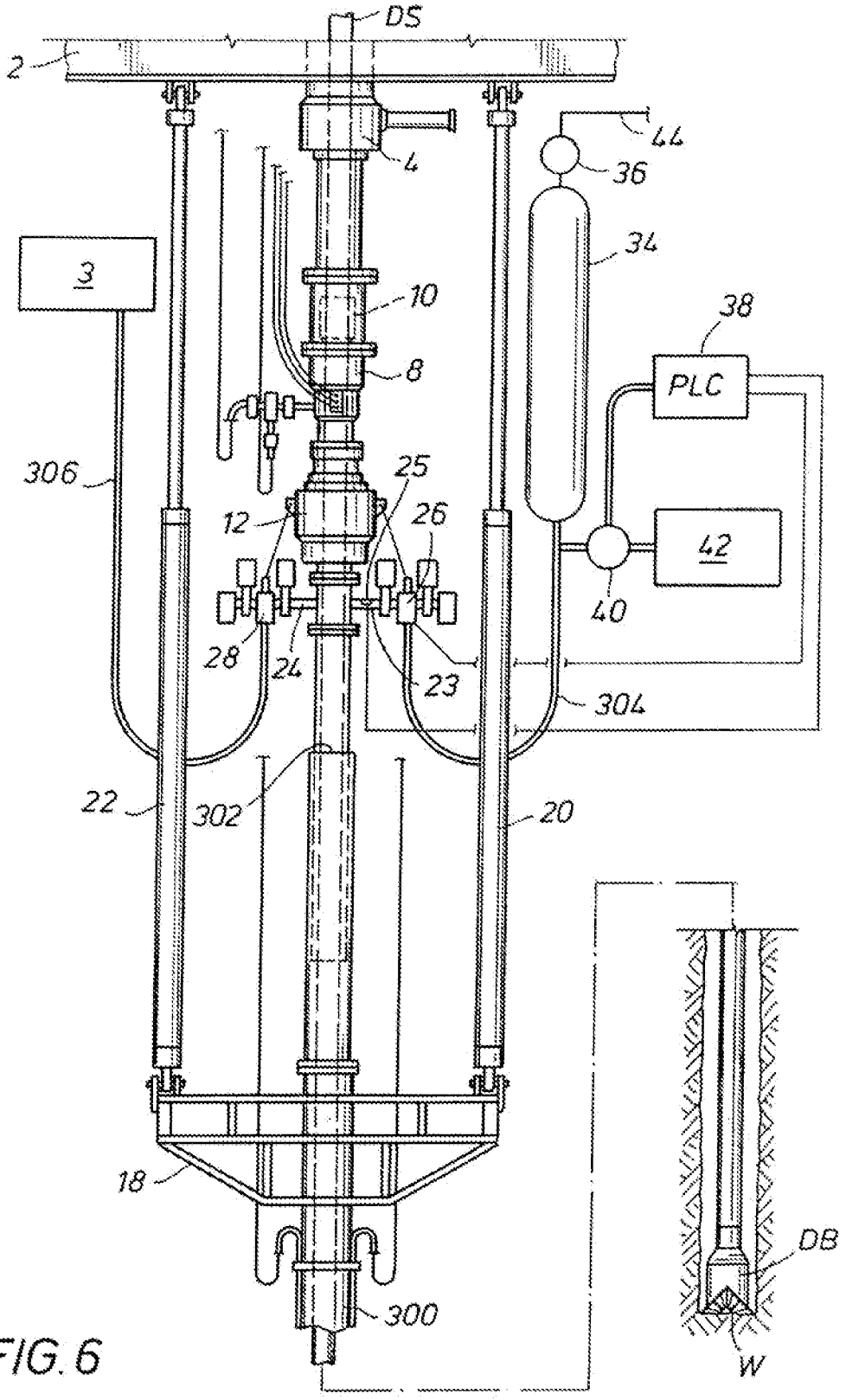
FIG. 6 is an elevational view of a riser with an RCD housing with a RCD shown in phantom, an annular BOP, a telescoping or slip joint below the annular BOP, and a drill string or other tubular in the riser with the drill bit in contact with the wellbore, and on the right side of the riser a first T-connector with a first valve attached with a first flexible flow line in fluid communication with an accumulator and a gas supply source through a pressure regulator, and on the left side of the riser a second T-connector with a second valve attached with a second flexible flow line connected with a choke manifold.

FIG. 6 is similar to FIG. 1, except in FIG. 6 the telescoping or slip joint 302 is located below the RCD 10 and annular BOP 12, and the drill bit DB is in contact with the wellbore W for drilling. The "slip joint piston" embodiment of FIG. 5 is similar to FIG. 6 when the telescoping joint 280, below the RCD 266, is in the unlocked position. When telescoping joint 280 is in the unlocked position, the below method with the drill bit DB on bottom may be used. Although the embodiment from FIG. 1 is shown on the right side of the riser 300 in FIG. 6, any embodiment shown in any of the Figures may be used with the riser 300 configuration shown in FIG. 6 to compensate for the heave induced pressure fluctuations caused by the telescoping movement of the slip joint 302 while drilling. As can be understood, telescoping joint 302 is disposed in the MPD "pressure vessel" in the riser 300 below the RCD 10.

Marine diverter 4 is disposed below the rig beam 2 and above RCD housing 8. RCD 10 is disposed in RCD housing 8 over annular BOP 12. The annular BOP 12 is optional. A surface ram-type BOP is also optional. There may also be a subsea ram-type BOP and/or a subsea annular BOP, which are not shown, but were discussed above and illustrated in FIG. 3. RCD housing 8 may be a housing such as the docking station housing in Pub. No. US 2008/0210471: however, other RCD housings are contemplated, such as the RCD housings disposed in a marine riser proposed in U.S. Pat. Nos. 6,470,975; 7,159,669; and 7,258,171. The RCD 10 may allow for MPD including, but not limited to, the CBHP variation of MPD. Drill string DS is disposed in riser 300 with the drill bit DB in contact with the wellbore W, such as when drilling is occurring. First flow line 304 is fluidly connected with accumulator 34, and second flow line 306 is fluidly connected with drilling choke manifold 3.

Method while Drilling

The methods described above for each of the embodiments shown in any of the Figures may be used with the riser 300 configuration shown in FIG. 6. When the telescoping joint 302 is heaving, the first valve 26 may be opened, including during drilling with the mud pumps turned on. It is contemplated that first valve 26 may be optional, since the systems and methods may be used both with the drill bit DB in contact with the wellbore W during drilling as shown in FIGS. 5 and 6 when their respective telescoping joint is unlocked or free to extend or retract, and with the drill bit DB spaced apart from the wellbore W during tubular connections or tripping.

As the rig heaves while the drill bit DB is drilling, the unlocked telescoping joint 280 of FIG. 5 and/or the telescoping joint 302 of FIG. 6 will telescope. When the rig heaves downward and the telescoping joint retracts, or shortens the riser, the volume of drilling fluid displaced by the riser shortening will flow through first valve 258 in flow line 256 to fluid container 282 of FIG. 5 and/or first valve 26 into first flow line 304 of FIG. 6 moving the liquid and gas interface toward the gas accumulator 34. However, the interface may move into the accumulator 34. In either scenario, the liquid volume displaced by the movement of the telescoping joint may be accommodated.

In FIG. 5, when the unlocked telescoping joint 280 extends, or lengthens the riser 268, the piston 284 moves upward in fluid container 282, moving fluid through flow line 256 into the riser 268. In FIG. 6, when the telescoping joint 302 extends, or lengthens the riser 300, the pressure of the gas, and the suction caused by the movement of the telescoping joint 302, will cause the liquid and gas interface to move along the first flow line 304 toward the riser 300, adding a volume of drilling fluid to the riser 300. A substantially equal amount of volume to that previously removed from the annulus is moved back into the annulus.

As can now be understood, all embodiments shown in FIGS. 1-5 and/or discussed therewith address the cause of the pressure fluctuations when the well is shut in for connections or tripping, or the rig's mud pumps are shut off for other reasons, which is the fluid volumes of the annulus returns that are displaced by the piston effect of the drill string or tubular heaving up and down within the riser and wellbore along with the rig. Further, the embodiments shown in FIGS. 1-5 and/or discussed therewith may be used with a riser configuration such as shown in FIGS. 5 and 6, with a riser telescoping joint located below an RCD, to address the cause of the pressure fluctuations when drilling is occurring and the rig's mud pumps are on, which is the fluid volumes of the annulus returns that are displaced by the telescoping movement of the telescoping joint heaving up and down along with the rig.

Any redundancy shown in any of the Figures for one embodiment may be used in any other embodiment shown in any of the Figures. It is contemplated that different embodiments may be used together for redundancy, such as for example the system shown in FIG. 1 on one side of the riser, and one of the two redundant systems shown in FIG. 3 on another side of the riser. It should be understood that the systems and methods for all embodiments may be applicable when the drill string is lifted off bottom regardless of the reason, and not just for the making of tubular connections during MPD or to circulate out a kick during conventional drilling.

The foregoing disclosure and description of the invention are illustrative and explanatory thereof, and various changes in the details of the illustrated apparatus and system, and the construction and method of operation may be made without departing from the spirit of the invention.

We claim:

1. A method, comprising the steps of:

pumping a fluid at a determined flow rate into a drill string disposed in a wellbore, the drill string being suspended from a drilling platform floating on a body of water;

measuring a fluid pressure of the fluid returning from the wellbore within a fluid discharge line, the fluid discharge line having a variable length portion configured to vary the length of the fluid discharge line to correspond to a change in elevation of the drilling platform above a bottom of the body of water;

determining a wellbore pressure at a selected position, the wellbore pressure being determined using at least the measured fluid pressure; and adjusting the determined wellbore pressure to account for changes in length of the fluid discharge line corresponding to changes in elevation of the drilling platform above the bottom of the body of water.

2. The method of claim 1, wherein the step of adjusting the determined wellbore pressure comprises the step of:

measuring a change in the pressure of the fluid in the fluid discharge line caused by the change in the length of the fluid discharge line.

3. The method of claim 2, wherein the step of measuring a fluid pressure.

4. The method of claim 1, further comprising the step of:

operating a backpressure system to maintain the adjusted determined wellbore pressure at a selected value.

5. The method of claim 4, wherein the step of operating the backpressure system comprises the steps of:

measuring a fluid pressure in the wellbore proximate a blowout preventer, and measuring a fluid pressure in the fluid discharge line at a position prior to a controllable orifice choke.

6. The method of claim 1, wherein the selected position is a position along the fluid discharge line or a position along the variable length portion of the fluid discharge line.

7. The method of claim 1, further comprising the step of:

operating a choke to maintain adjusted well bore pressure at a selected value.

8. The method of claim 1, further comprising the step of:

measuring fluid pressure in the fluid discharge line in at least two spaced-apart positions.

9. The method of claim 8, further comprising the step of:

measuring fluid pressure of the fluid discharge line using a sensor.

10. The method of claim 1, further comprising the step of:

measuring fluid flow rate through the fluid discharge line.

11. The method of claim 1, further comprising the steps of:

maintaining a fluid level in a tank receiving fluid from the wellbore, and adjusting the maintained fluid level for changes in volume resulting from changes in the length of the fluid discharge line.

12. A method, comprising the steps of:

pumping a fluid through a drill string extended from a drilling platform into a wellbore drilled through a subsurface formation;

measuring a first fluid pressure in an annular space between the drill string and a riser;

measuring a second fluid pressure proximate a fluid outlet from the annular space, the annular space arranged and designed to change length as a result of a heave of the drilling platform; and controlling a flow restriction device to maintain a selected pressure in the wellbore based upon the first and second fluid pressures.

13. A method, comprising the steps of:

pumping a fluid into a drill string disposed in a wellbore, the drill string being suspended from a drilling platform floating on a body of water;

measuring a fluid pressure of the fluid returning from the wellbore within a fluid discharge line, the fluid discharge line having a variable length portion configured to vary the length of the fluid discharge line to correspond to a change in elevation of the drilling platform above a bottom of the body of water;

determining a wellbore pressure at a selected position, the wellbore pressure being determined using at least the measured fluid pressure;

adjusting the determined wellbore pressure to account for changes in length of the fluid discharge line corresponding to changes in elevation of the drilling platform above the bottom of the body of water;

determining a change in length of the fluid discharge line; and measuring a change in the pressure of the fluid in the fluid discharge line caused by the change in the length of the fluid discharge line.

14. The method of claim 13, wherein the step of measuring a fluid pressure comprises a sensor.

15. The method of claim 13, further comprising the step of:

operating a backpressure system to maintain the adjusted determined wellbore pressure at a selected value.

16. The method of claim 15, wherein the step of operating the backpressure system comprises the steps of;

measuring a fluid pressure in the wellbore proximate a blowout preventer, and measuring a fluid pressure in the fluid discharge line at a position prior to a controllable orifice choke.

17. The method of claim 13, wherein the selected position is a position along the fluid discharge line or a position along the variable length portion of the fluid discharge line.

18. The method of claim 13, further comprising the step of:

operating a choke to maintain adjusted well bore pressure at a selected value.

19. The method of claim 13, further comprising the step of:

measuring fluid pressure in the fluid discharge line in at least two spaced-apart positions.

20. The method of claim 19, further comprising the step of:

measuring fluid pressure of the fluid discharge line using a sensor.

21. The method of claim 13, further comprising the step of:

measuring fluid flow rate through the fluid discharge line.

22. The method of claim 13, further comprising the steps of:

maintaining a fluid level in a tank receiving fluid from the wellbore, and adjusting the maintained fluid level for changes in volume resulting from changes in the length of the fluid discharge line.

23. A method, comprising the steps of:

pumping a fluid into a drill string disposed in a wellbore, the drill string being suspended from a drilling platform floating on a body of water;

measuring a fluid pressure of the fluid returning from the wellbore within a fluid discharge line, the fluid discharge line having a variable length portion configured to vary the length of the fluid discharge line to correspond to a change in elevation of the drilling platform above a bottom of the body of water;

determining a wellbore pressure at a selected position, the wellbore pressure being determined using at least the measured fluid pressure;

adjusting the determined wellbore pressure to account for changes in length of the fluid discharge line corresponding to changes in elevation of the drilling platform above the bottom of the body of water; and operating a backpressure system to maintain the adjusted determined wellbore pressure at a selected value.

24. The method of claim 23, wherein the step of adjusting the determined wellbore pressure comprises the step of:

measuring a change in the pressure of the fluid in the fluid discharge line caused by the change in the length of the fluid discharge line.

25. The method of claim 24, wherein the step of measuring of fluid pressure comprises a sensor.

26. The method of claim 23, further comprising the step of:

measuring fluid flow rate through the fluid discharge line.

27. The method of claim 23, further comprising the steps of:

maintaining a fluid level in a tank receiving fluid from the wellbore, and adjusting the maintained fluid level for changes in volume resulting from changes in the length of the fluid discharge line.

28. A method, comprising the steps of:

pumping a fluid into a drill string disposed in a wellbore, the drill string being suspended from a drilling platform floating on a body of water;

measuring a fluid pressure of the fluid returning from the wellbore within a fluid discharge line, the fluid discharge line having a variable length portion configured to vary the length of the fluid discharge line to correspond to a change in elevation of the drilling platform above a bottom of the body of water;

determining a wellbore pressure at a selected position, the wellbore pressure being determined using at least the measured fluid pressure;

adjusting the determined wellbore pressure to account for changes in length of the fluid discharge line corresponding to changes in elevation of the drilling platform above the bottom of the body of water; and measuring a fluid flow of the fluid discharge line.

29. The method of claim 28, wherein the step of adjusting the determined wellbore pressure comprises the step of:

measuring a change in the pressure of the fluid in the fluid discharge line caused by the change in the length of the fluid discharge line.

30. The method of claim 29, wherein the step of measuring of fluid pressure.

31. The method of claim 28, further comprising the step of:

operating a backpressure system to maintain the adjusted determined wellbore pressure at a selected value.

32. The method of claim 28, wherein the selected position is a position along the fluid discharge line or a position along the variable length portion of the fluid discharge line.

* * * * *